US010288384B2

(12) United States Patent
Kinnings

(10) Patent No.: US 10,288,384 B2
(45) Date of Patent: May 14, 2019

(54) TACTICAL LOAD-BEARING VEST

(71) Applicant: Brady Alan Robinson Kinnings, Colorado Springs, CO (US)

(72) Inventor: Brady Alan Robinson Kinnings, Colorado Springs, CO (US)

( * ) Notice: Subject to any disclaimer, the term of this patent is extended or adjusted under 35 U.S.C. 154(b) by 771 days.

(21) Appl. No.: 14/811,647

(22) Filed: Jul. 28, 2015

(65) Prior Publication Data

US 2016/0033235 A1 Feb. 4, 2016

Related U.S. Application Data

(60) Provisional application No. 62/030,162, filed on Jul. 29, 2014.

(51) Int. Cl.

| | |
|---|---|
| ***F41H 1/00*** | (2006.01) |
| ***F41H 1/02*** | (2006.01) |
| ***A41D 13/05*** | (2006.01) |
| ***A45F 3/12*** | (2006.01) |
| ***A45F 3/06*** | (2006.01) |
| ***A45F 3/14*** | (2006.01) |
| *A45F 3/00* | (2006.01) |

(52) U.S. Cl.

CPC ..... *F41H 1/02* (2013.01); *A41D 13/05* (2013.01); *A45F 3/06* (2013.01); *A45F 3/12* (2013.01); *A45F 3/14* (2013.01); *A45F 2003/001* (2013.01); *A45F 2003/003* (2013.01); *A45F 2003/127* (2013.01); *A45F 2003/146* (2013.01)

(58) Field of Classification Search

CPC ... A41D 13/05; A45F 3/06; A45F 3/12; A45F 3/14; A45F 2003/001; A45F 2003/003

See application file for complete search history.

(56) References Cited

U.S. PATENT DOCUMENTS

| | | | | |
|---|---|---|---|---|
| 6,536,641 | B1 * | 3/2003 | Sundara | A45F 3/08 224/631 |
| 8,479,312 | B2 * | 7/2013 | Dovner | F41H 1/02 2/2.5 |
| 8,523,029 | B2 * | 9/2013 | Rogers | A45F 5/02 224/182 |

(Continued)

*Primary Examiner* — Richale L Quinn

(74) *Attorney, Agent, or Firm* — Moazzam & Associates, LLC

(57) ABSTRACT

This disclosure relates generally to a tactical load-bearing system comprising a vest and a supporting waist belt. A rigid rear frame comprising a spine extension, and a pair of shoulder panels, enables a load transfer from a user's shoulders to the supporting waist belt via the spine extension. A plurality of fabric panels including pockets for housing ballistic plates and attachment mechanisms for coupling together may also be quickly decoupled by a quick-release mechanism that comprises one or more quick-release cables. The rigid rear frame may include a rigging system or a rack system, enabling a user to carry additional equipment on the vest, such as a radio, battery, etc. A fine adjustment mechanism includes a tension cable routed through a pair of waist panels and coupled with a pair of tension plates located adjacent a back end of each waist panel. The modular coupling of each panel combined with the non-fixed load-bearing mechanism and quick-release mechanism enable users such as military personnel to respond to situations without being hindered by existing bulky or non-ergonomic load-carrying systems.

18 Claims, 21 Drawing Sheets

(56) References Cited

U.S. PATENT DOCUMENTS

| | | | | |
|---|---|---|---|---|
| 8,572,762 | B2 * | 11/2013 | Herbener | F41H 1/02 2/2.5 |
| 8,899,526 | B2 * | 12/2014 | Copenhaver | B64D 17/30 224/637 |
| 8,990,971 | B2 * | 3/2015 | Carter | A45F 3/10 2/2.5 |
| 8,991,671 | B2 * | 3/2015 | Gill | A45F 3/04 224/628 |
| 9,144,255 | B1 * | 9/2015 | Perciballi | A41D 27/00 |
| 9,161,609 | B2 * | 10/2015 | Milligan | A45F 3/047 |
| 9,629,443 | B2 * | 4/2017 | Searle | A45F 3/10 |
| 9,770,626 | B2 * | 9/2017 | Rose | A63B 29/02 |
| 9,777,997 | B2 * | 10/2017 | Swan | F41H 1/02 |
| 9,820,514 | B2 * | 11/2017 | Nykoluk | A41D 13/0007 |
| 9,933,233 | B1 * | 4/2018 | Roccisano | F41C 33/0209 |
| 2010/0076359 | A1 * | 3/2010 | Glenn | A45F 3/14 602/19 |
| 2014/0151424 | A1 * | 6/2014 | Hexels | A45F 3/06 224/637 |
| 2014/0305982 | A1 * | 10/2014 | Pelland | A45F 3/06 224/576 |
| 2015/0189974 | A1 * | 7/2015 | Bercaw | A45F 3/04 224/633 |

* cited by examiner

TACTICAL LOAD-BEARING VEST

This application claims priority to U.S. Provisional Patent Application Ser. No. 62/030,162, filed on Jul. 29, 2014, the contents which are hereby incorporated by reference herein in their entirety into this disclosure.

TECHNICAL FIELD

The subject disclosure relates generally to tactical body armor. Specifically, the subject disclosure relates to a load-bearing vest.

BACKGROUND OF THE SUBJECT DISCLOSURE

It has become increasingly obvious to users and the U.S. Army that the additional technology users carry has put a heavy burden on their shoulders. U.S. Army users, such as soldiers, carry excessive loads during sustained battles. These loads are mainly distributed over their shoulders, limiting movement, speeding the rate of fatigue, and increasing the likelihood of numerous injuries. These users have prolonged contact with the body armor, MOLLE and other combat equipment, spending days in a combat zone with only the equipment they carry. Their loads far exceed the Army Chief of Staff's maximum weight limit, and they remain overburdened with the weight of technology. It is known that consideration to load distribution and ergonomics that minimize fatigue will increase a user's overall effectiveness. However, existing plate carriers and "Interceptor" or IOTV style body armor are either too minimal to provide adequate safety, or too heavy to enable routine movements to be freely performed. What is needed is a framework that provides a balance between ballistic protection and agility, and enables soldiers and other users to quickly carry out basic and routine movements comfortably.

SUMMARY OF THE SUBJECT DISCLOSURE

The above-identified problems in the prior art may be overcome by providing an upper vest comprising a plurality of overlapping panels including a rigid back frame, a vertical spine extension, and a supporting waist belt comprising a cradle for receiving the spine extension. The spine extension may be raised when not in use, and lowered until it makes contact with the cradle of the supporting belt. In a lowered state, the spine extension ergonomically transfers load from the vest to the supporting belt. The cradle of the supporting belt may have a concave upper surface that is adapted to cradle the lowered spine extension. The spine extension may be automatically retracted into a raised state using a spring controlled by a trigger. A non-fixed coupling of the spine extension of the vest with the cradle of the supporting belt enables a user to easily dislocate the vest from the belt in order to perform a torso movement, such as a twist or a lean.

The plurality of overlapping sections of the upper vest may include a back panel for housing the rigid back frame, a pair of rigid shoulder panels for transferring load from the shoulders to the rigid back frame, a chest panel, and a pair of waist panels. In some embodiments, the chest frame may be fused with one of the waist panels. In either case, the separate panels are coupled to each other using various connecting means, as further described herein. The panels may include fabric covers having attachment mechanisms such as VELCRO or fabric loops for connecting to each other. A back panel or back frame may include a rigging system or a rack system, enabling a user to carry additional equipment on the vest, such as a radio, battery, etc.

Each panel may include one or more pockets for housing protective plates such as Kevlar, ballistic plates, padding, and rigid or hard plastic supporting members in the case of the shoulder and back panels. For example, the plates may include Enhanced Small Arms Protective Insert (ESAPI) plates. Fabric loops with hook-and-loop fasteners may be used to secure plates within the pocket, thereby ensuring that a user is fully protected. Moreover, the panels may be decoupled or disconnected from each other using one or more quick-release means. A quick-release cable may be routed through each panel, and through fabric loops located at the end points of one or more panels. For instance, a shoulder panel may include at its front end a fabric loop that is adapted to be inserted through one or more fabric loops on the chest panel. The quick-release cable may be routed through the one or more loops, with tension in the cable keeping the shoulder strap in place. The panels may be decoupled by pulling the cable through the panels, or by releasing the tension in the cable.

The chest panel couples at its top end to a front end of each shoulder panel and on either side to each waist panel. The chest panel may further include pockets or compartments for housing ballistic and Kevlar plates, and an attachment for a crotch protector. A height of the protective ballistic and/or Kevlar plates may be adjustable to protect differently-sized torsos. The chest panel further includes a quick-release mechanism for releasing the quick-release cable connecting the plurality of panels comprised by the vest, enabling the vest to fall apart quickly. For instance, a housing in the chest panel may be opened to expose the quick-release mechanism that is coupled to the quick-release cables routed through the other panels comprised by the vest.

Each shoulder panel may comprise an attachment point for enabling a backpack having compatible straps to be attached to the vest. The attachment point can include a buckle part coupled to the shoulder panel that is adapted to receive a corresponding buckle part coupled to a strap of the backpack, enabling a quick and removable attachment. When the vest is in use, a hard or stiff plastic curved portion within each shoulder panel transfers weight of the backpack from resting on the shoulders to resting on the supporting belt via the rigid back frame and spine extension. An upper surface of each shoulder panel may be concave in its cross-section, thereby forming a groove or channel for the shoulder straps of the backpack, and preventing the straps from slipping out. One or both shoulder panels may also comprise a rifle pad adapted for providing support to a stock of a rifle or a backpack strap when in use.

As described herein, the load-bearing vest and belt are intended to transfer a weight of a backpack from the shoulders to the hips, when fully assembled. During initial assembly, the various connecting means for connecting the vest panels may include adjusting means enabling the vest to be worn by users having differently-sized torsos. In some exemplary embodiments, the vest also includes a second adjustment means for making small adjustments when the vest is fully assembled. For instance, a tension cable may be routed from an adjusting means housed towards the front of the vest through fixed cable housing in each waist panel and connecting the back ends of each waist panel. One or more vertically aligned tension plates may be housed at a rear end of each waist panel, with the tension cable connecting the tension plates, thereby pulling the waist panels together evenly and enabling the tension to be uniformly distributed around a user's waist. By manipulating the adjusting means, the user may tighten or loosen the tension in the adjustment cable, thereby adjusting the fit of the vest, as further described herein. The tension in the adjustment cable may be manipulated via a reel such as the Boa Technologies reel described in U.S. Pat. No. 7,950,112, the contents of which are hereby incorporated by reference herein in their entirety.

DETAILED DESCRIPTION OF THE SUBJECT DISCLOSURE

The following detailed description references specific embodiments of the subject disclosure and accompanying figures, including the respective best modes for carrying out each embodiment. It shall be understood that these illustrations are by way of example and not by way of limitation.

Figure 1A:
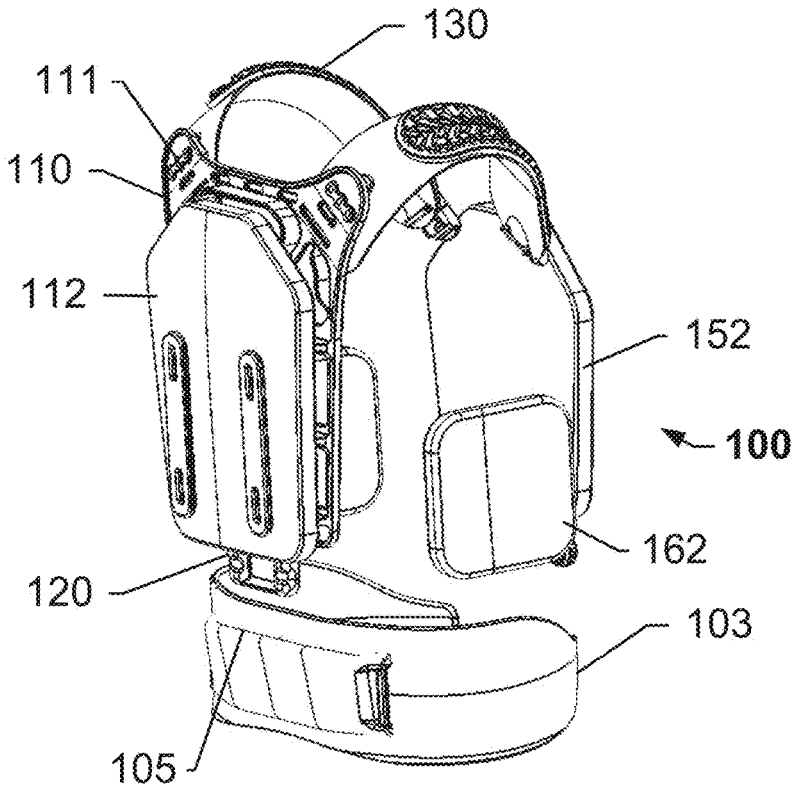
FIGS. 1A and 1B show views of an assembled vest and a supporting waist belt, according to an exemplary embodiment of the subject disclosure.
Figure 1B:
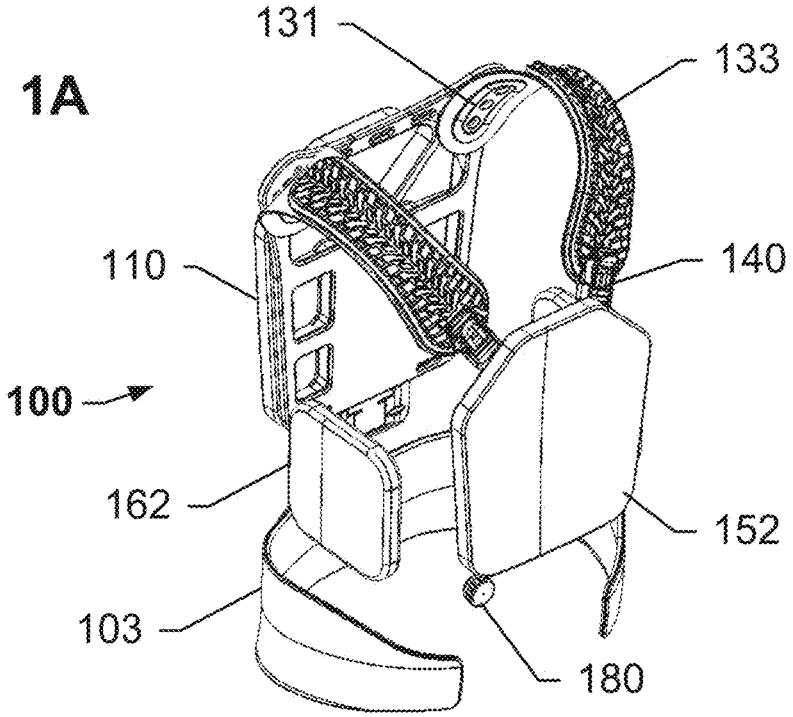

FIGS. 1A and 1B show views of an assembled vest 100 and a supporting waist belt 103, according to an exemplary embodiment of the subject disclosure. With reference to FIG. 1A, an upper vest 100 comprises a plurality of overlapping panels including a rigid back frame 110 coupled to a vertical spine extension 120, and a supporting waist belt 103 comprising a cradle 105 for receiving the vertical spine extension 120. Spine extension 120 may be raised or retracted when not in use, and lowered or extended until it makes contact with cradle 105 of supporting belt 103. In a lowered state, spine extension 120 ergonomically transfers load from the shoulder panels 130 to supporting belt 103 via the combination of rigid back frame 110 and spine extension 120. This framework reduces compaction of the spine, alleviating much of the upper body fatigue and injuries associated with heavy load-carrying. Shoulder panels 130 transfer load to rigid back frame 110 via bolt holes 111 in rigid back frame 110. Other alternatives to bolt holes 111 may be provided to connect the shoulder panels 130 to rigid back frame 110, including snap fits, male/female adapters, etc. Cradle 105 of supporting belt 103 may have a concave upper surface that is adapted to cradle spine extension 120 when extended. Spine extension 120 may be automatically retracted into a raised state using a spring controlled by a trigger, as further described herein. Further, the non-fixed coupling of spine extension 120 with cradle 105 enables a user to easily dislocate the vest from the belt in order to perform a torso movement, such as a twist or a lean. Supporting belt 103 may have a low and smooth profile to keep from impacting a user's movements, and may be adjustable to fit differently-sized users. Further, supporting belt 103 may include straps and buckles that enable it to be worn and adjusted easily by users of different sizes. Fabric panels may be coupled to, may enclose, or may be attached underneath supporting belt 103, including pockets for Kevlar plates, or other components.

Further, with reference to FIG. 1B, each shoulder panel 130 may include coupling interfaces 131 enabling attachment to rigid back frame 110 via bolt holes 111. Each shoulder panel 130 further includes a buckle assembly 140 that enables a backpack having compatible straps to be attached to vest 100. Existing backpacks may easily be modified to be able to couple to a receiving end of attachment point 140, as further shown with respect to FIG. 5. The coupling via attachment point 140 may be easily removable, i.e is a non-fixed coupling. Further, an upper surface of each shoulder panel 130 may be concave in its cross-section, thereby forming a groove or channel for the shoulder straps of the backpack, and preventing the straps from slipping out. One or both shoulder panels 130 may also comprise a non-slip surface or pad 133 adapted for providing support to a rear end of a rifle when in use.

Upper vest 100 further includes a plurality of ballistic plates such as a back plate 112, a front plate 152, and side plates 162, each of which may be held in place by a fabric casing or panel that is not currently shown. For instance, rigid back frame 110 may be coupled to a fabric panel that includes pockets for housing ballistic plate 112. Each shoulder panel 130 may be housed in or coupled to a fabric panel that includes attachment points for attaching to a fabric chest panel. The fabric chest panel may include a pocket for front plate 152, and may include attachment points to attach to the attachment points of each shoulder panel 130. Side plates 162 may be held in place by fabric waist panels that include attachment points for connecting to a fabric cover of back frame 110 and, at their front ends, to the chest panel. The fabric may include one or more pockets for housing the protective ballistic plates shown herein, as well as Kevlar, and/or additional protection as well as storage. The separate fabric panels may be coupled to each other using various connecting means, such as a quick-disconnect cable and fabric loops, as further described herein with respect to FIGS. 7-9.

The frame components may be constructed from any material suitable for optimal load transfer. For instance, the frame, shoulder panel base, and supporting waist belt may be constructed from polycarbonate (PC), polyethylene HDPE, or GFRP with longitudinal fibers. The fabric panels for housing ballistic plates may be constructed from 1000 Denier CORDURA®, or a similar ripstop nylon.

Figure 2A:
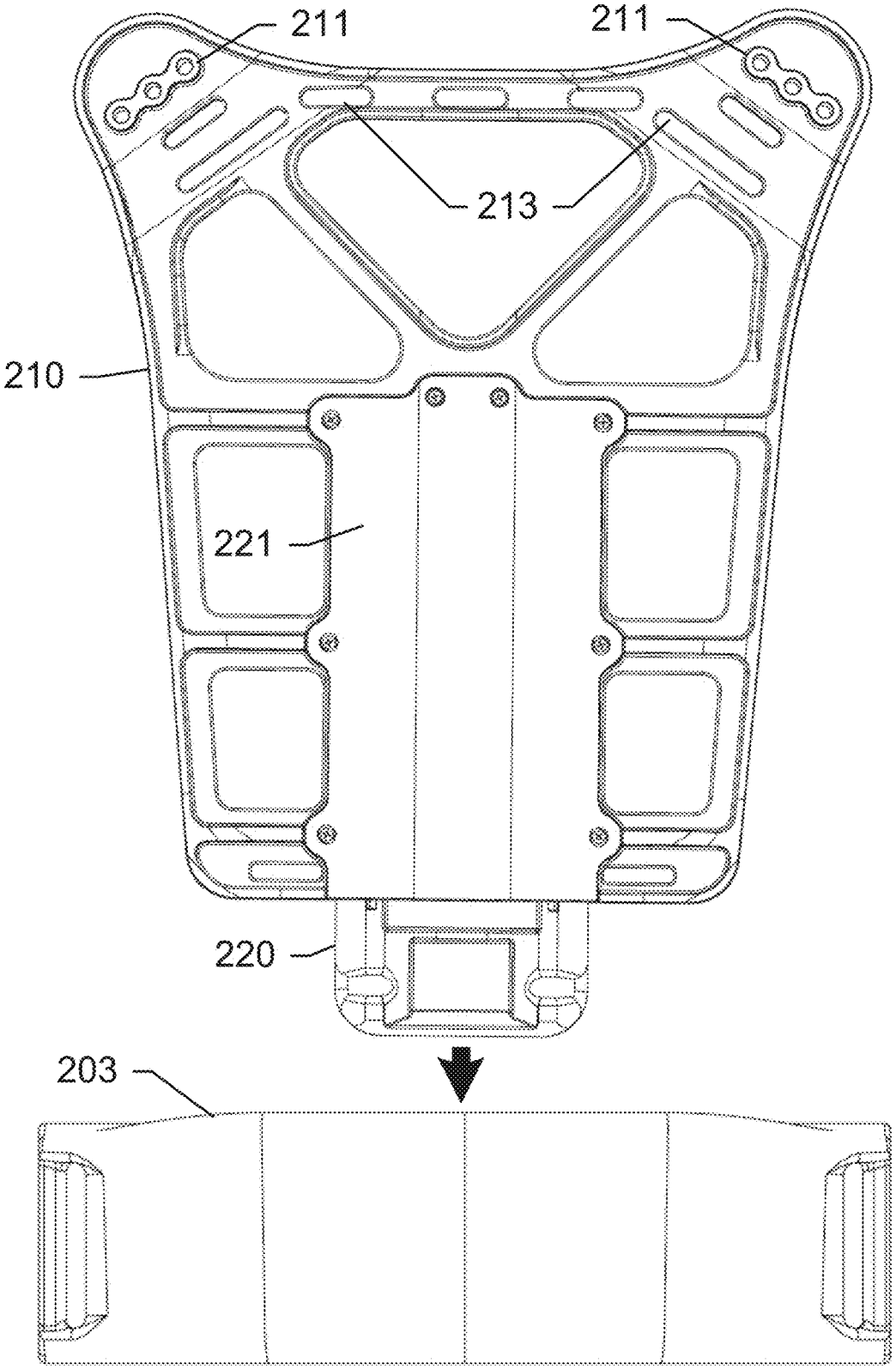
FIGS. 2A-2C show views of a rigid frame of the vest and a supporting waist belt, according to an exemplary embodiment of the subject disclosure.
Figure 2B:
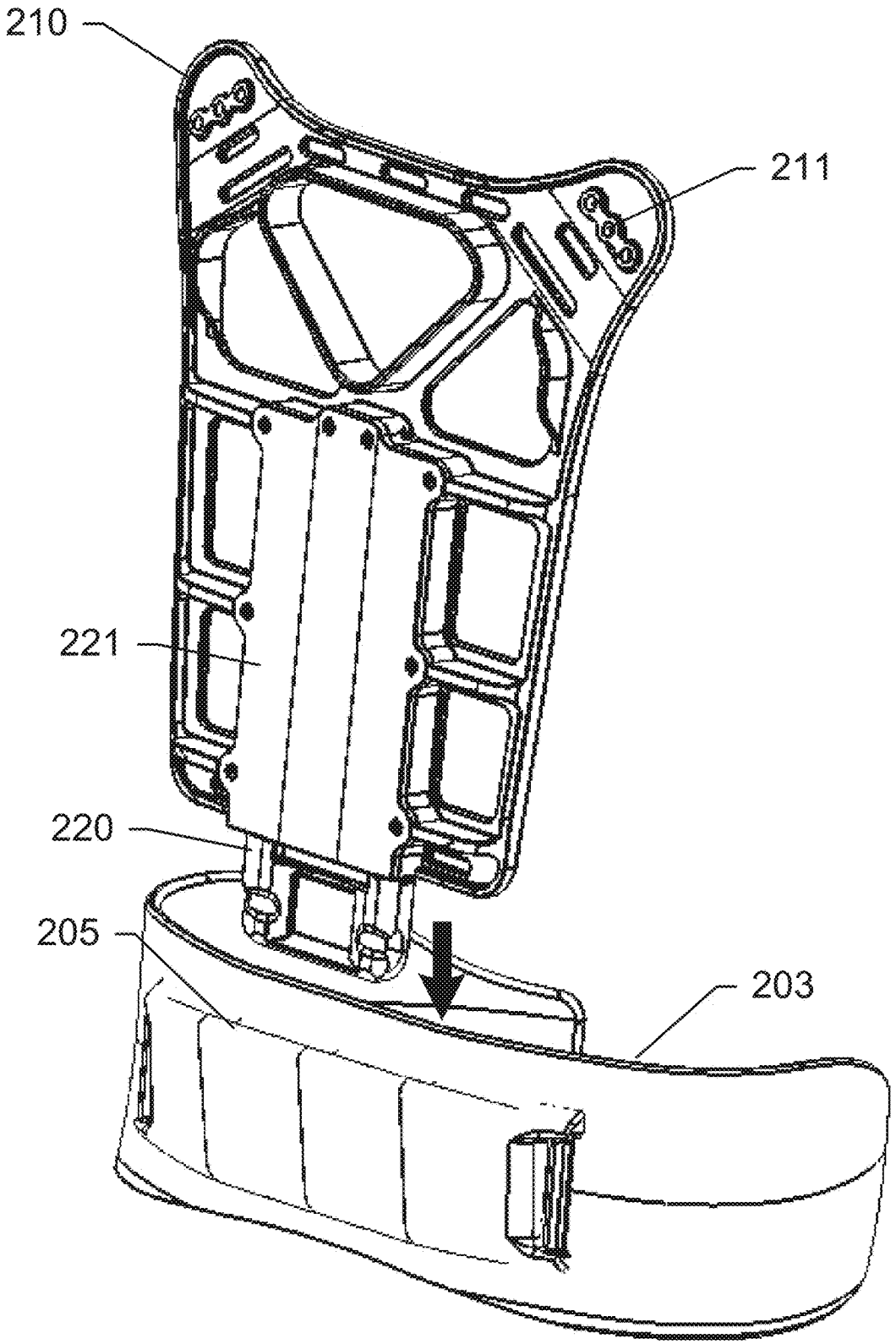
Figure 2C:
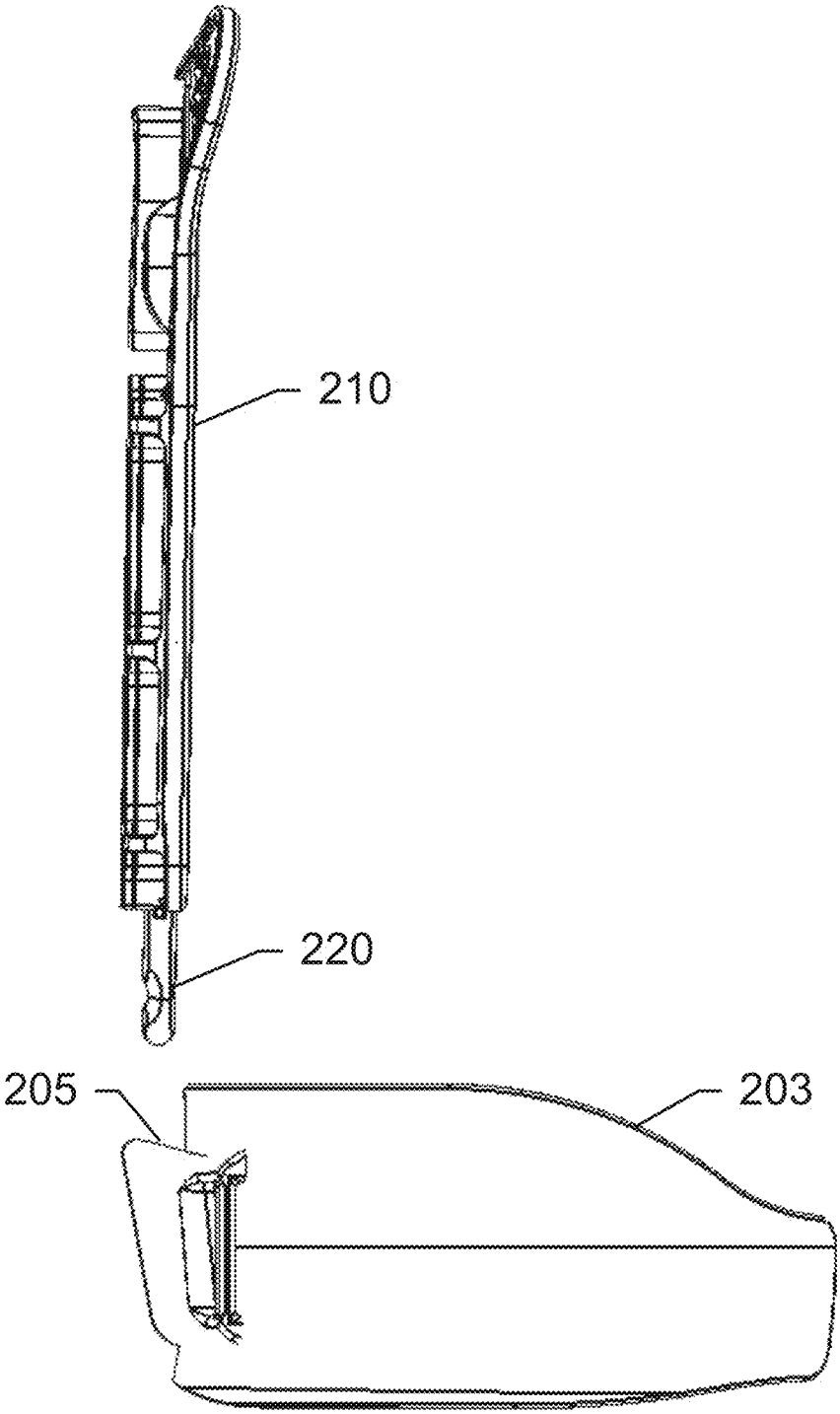

FIGS. 2A-2C show views of a rigid back frame of the vest and a supporting waist belt, according to an exemplary embodiment of the subject disclosure. With reference to FIG. 2A, rigid back frame 210 includes bolt holes 211 on each top corner for attaching to shoulder panels, a plurality of slots 213 for attaching to fabric panels, and a spine extension 220 in a housing covered by plate 221. Bolt holes 211 may removably or fixedly couple to a coupling interface that is part of the shoulder panel as further shown herein. In either case, the coupling may be rigid in order to efficiently transfer load from the shoulder panel to the back panel. For instance, bolts may be used to couple the coupling interface to bolt holes 211. Varying placement of bolt holes 211 enable the shoulder panel to be spaced differently for differently-sized torsos. Moreover, a retracting mechanism for retracting spine extension 220 may be wired through the shoulder panel.

Frame 210 may be housed within or coupled to a fabric panel via slots 213 that are designed to receive fabric flaps or Velcro flaps that are affixed to the fabric panel. The fabric panel may further include pockets for Kevlar and ballistic plates. The fabric may include padding. In some embodiments, the fabric panel may completely cover frame 210, and may include a pocket on an inner side for housing a Kevlar panel close to the torso of a user, and a pocket on an outer side for housing a ballistic plate. Frame 210 may be inserted into a middle pocket within the fabric, or held in place by fabric strips with hook-and-loop sections. This enables the Kevlar to protect the torso from any shrapnel caused by a projectile hitting the ballistic plate on the outside. In either case, frame 210 may be positioned relative to the fabric panel at a height that is approximately flush with the bottom of a user's neck, thereby enabling full mobility of the neck.

FIG. 2B shows frame 210 and supporting waist belt 203 from an isometric perspective. When in use, spine extension 220 may be lowered in the direction of the arrow towards cradle 205 of supporting waist belt 203, until contact is made. FIG. 2C shows a side view of frame 210 and supporting waist belt 203. As is evident from this drawing, the surface of cradle 205 is designed in a manner to securely hold spine extension 220 in a lowered state, such that the weight of any load bearing on frame 210 from a backpack may be securely supported by cradle 205 that is coupled to a user's hips via belt 203.

Figure 3A:
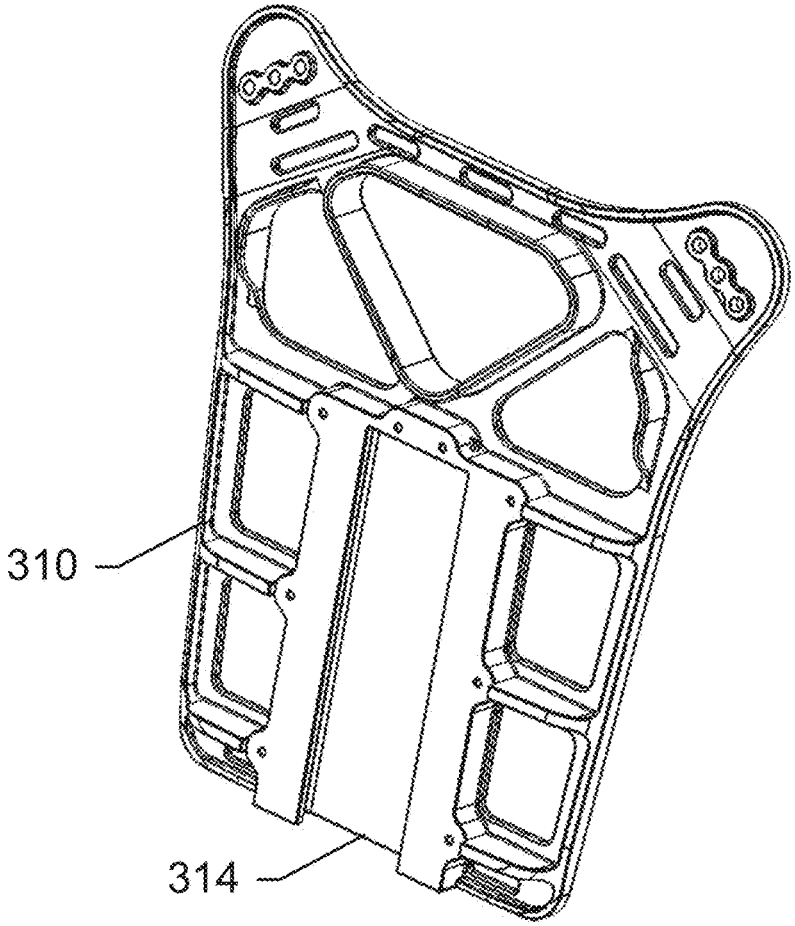
FIGS. 3A-3E show the components of the rigid frame and a spine extension within the rigid frame, according to an exemplary embodiment of the subject disclosure.

FIGS. 3A-3E show the components of a spine extension housed within a rigid rear frame, according to an exemplary embodiment of the subject disclosure. As described above, conditions associated with heavy load-carrying such as compaction of the spine, upper body fatigue, and other injuries may be alleviated by a spine extension that ergonomically transfers load from the shoulder panels to a supporting belt via a combination of a rigid back frame and a spine extension. With reference to FIG. 3A, frame 310 includes a housing 314 for housing a spine extension that is not currently shown. Housing 314 may be sized sufficient for a length of a spine extension to be completely retracted into housing 314, and may include guiding grooves or rails for enabling smooth extension and retraction of a spine extension.

Figure 3B:
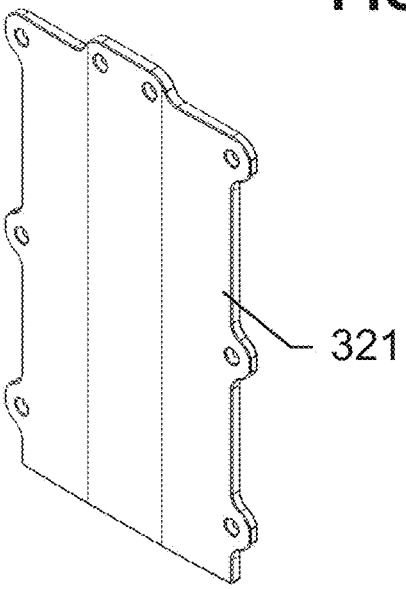
Figure 3C:
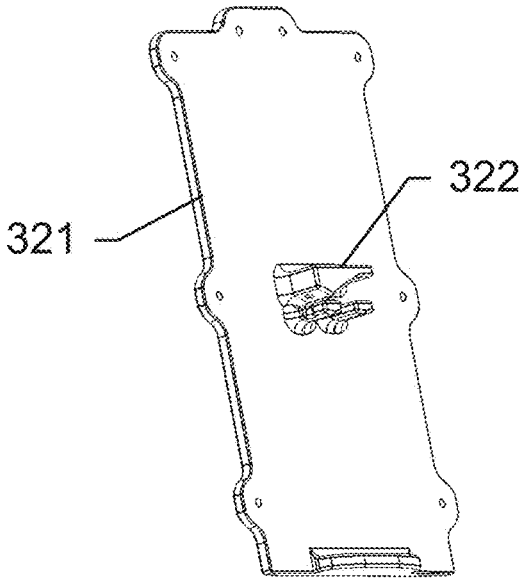
Figure 3D:
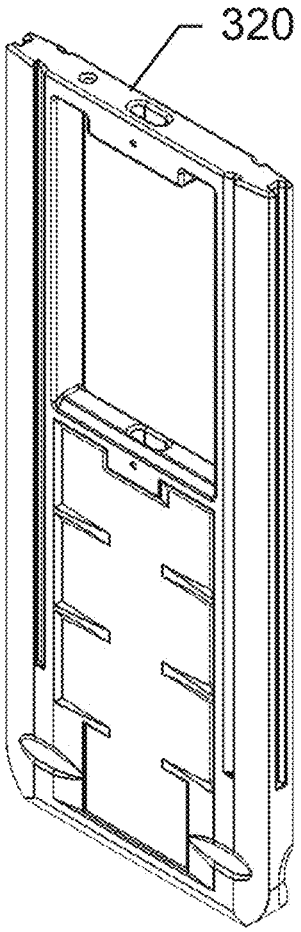
Figure 3E:
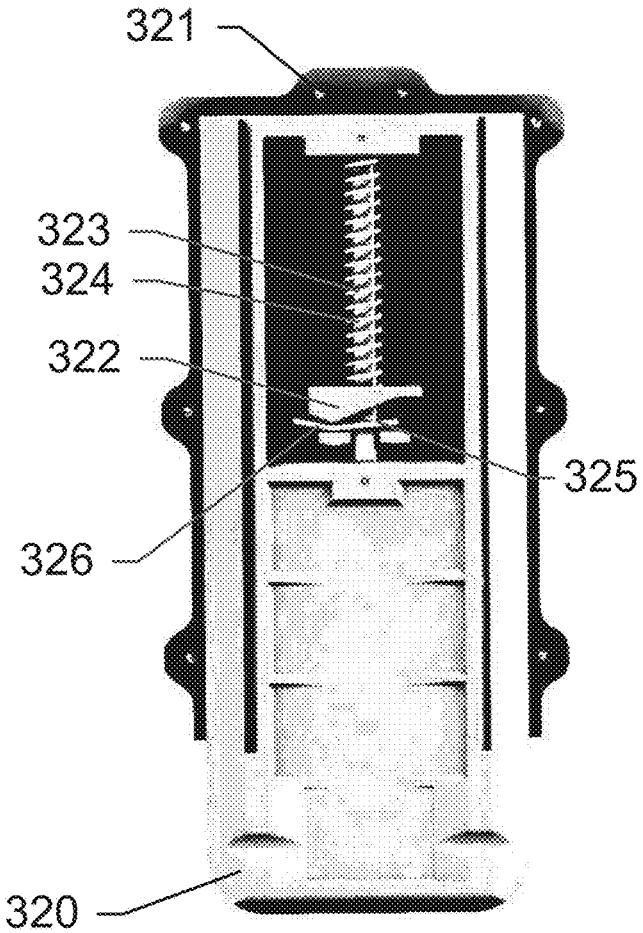

FIGS. 3B and 3C show a cover 321 for housing 314. Cover 321 is designed to fit securely over housing 314, and to be bolted to frame 310 via a plurality of bolt holes. Further, cover 321 may include a spring support 322 on its inner surface, such that when bolted over housing 314, spring support 322 is completely enclosed within housing 314. The reason for this is apparent when referring to FIGS. 3D and 3E, which respectively show a spine extension 320, and a view of spine extension 320 coupled to cover 321, and being held up by spring 323 resting on spring support 322. Spring 323 may be coiled around a smooth metal shaft 324. Spine extension 320 travels along a bind-free track, and may lock at various lengths to provide load relief depending on the need. Further, a spring-loaded collapse feature that allows the user to quickly retract the extension to regain full torso movement. For instance, spring 323 keeps extension 320 in a retracted state. When extension 320 is pulled downwards, spring 323 may be compressed. As described herein, extension 320 may be automatically retracted into a raised state using a trigger for releasing spring 323 from its compressed state. Extension 320 may include a plurality of notches that enable it to remain in an extended state with spring 321 compressed. A locking lever 325 just below spring support 322 may bind/lock on smooth metal shaft 324 inside spring 323, or allow free travel along the length of smooth metal shaft 324. As extension 320 is pulled down, locking lever 325 allows smooth metal shaft 324 to smoothly pass through it. As downward force ceases, a spring 326 that holds locking lever 325 at an angle, moves lever 325 at an angle at which lever 325 locks onto shaft 324. This locking stops the extension from upwards movement, since spring 326 applies pressure to lever 325 by pushing off spring support 322.

A quick-retraction mechanism may be used to release extension 320 from an extended state, enabling the potential energy in spring 321 to return to a non-compressed state. For example, a quick release cable for retracting extension 320 may be attached to lever 325, where it extends beyond spring support 322 and runs upwards through a system of shafts. For example, the cable may run along one side of the vest to a point that is accessible by a user.

The coupling of extension 320 to cover 321 does not need to be a fixed coupling. During construction or assembly, extension 320 may simply be properly aligned with cover 321, with spring 323 situated on spring support 322. When this assembly is placed within housing 314 of frame 310, and cover 321 securely bolted to frame 310, then the spine extension is held in place simply by virtue of being securely enclosed within housing 314 and cover 321. Moreover, as described herein, the trigger for the quick-retraction mechanism for extension 320 may be coupled to a cable that is routed to within a convenient location that is within reach of a user's hand. For instance, the trigger may be positioned towards a front end of the shoulder panel or on a chest panel, and may be coupled to a wire or cable for engaging the spring for retracting the spine extension when not in use. Other embodiments including varying positions of the spine extension retraction trigger are possible without detracting from the novel scope and spirit of this disclosure.

Figure 4A:
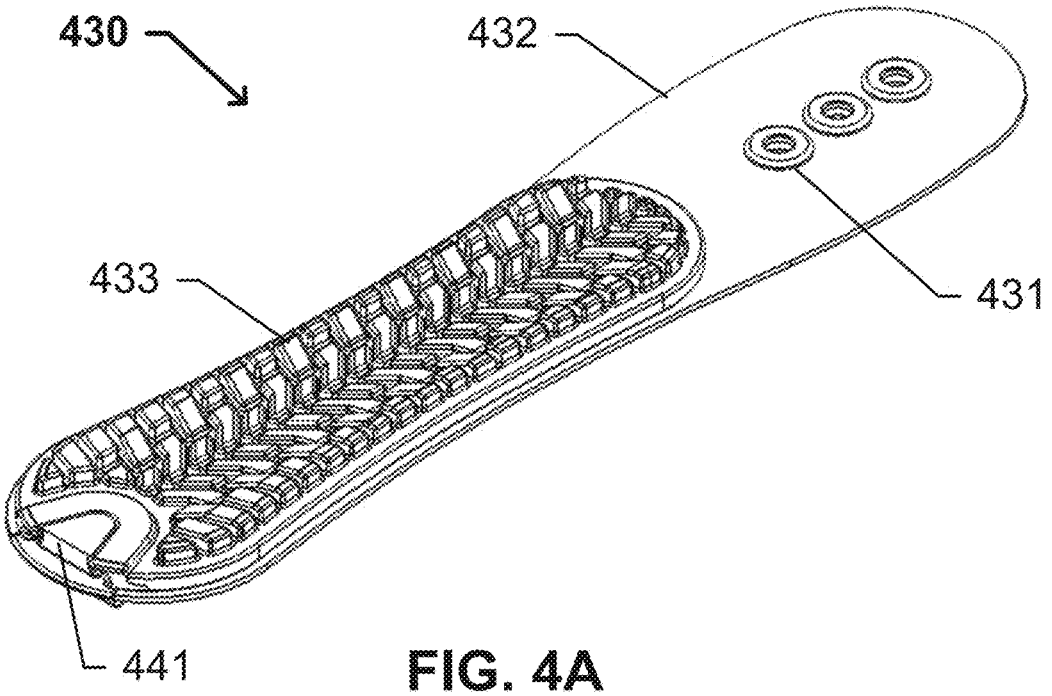
FIGS. 4A and 4B show views of a shoulder panel and its components, according to an exemplary embodiment of the subject disclosure.
Figure 4B:
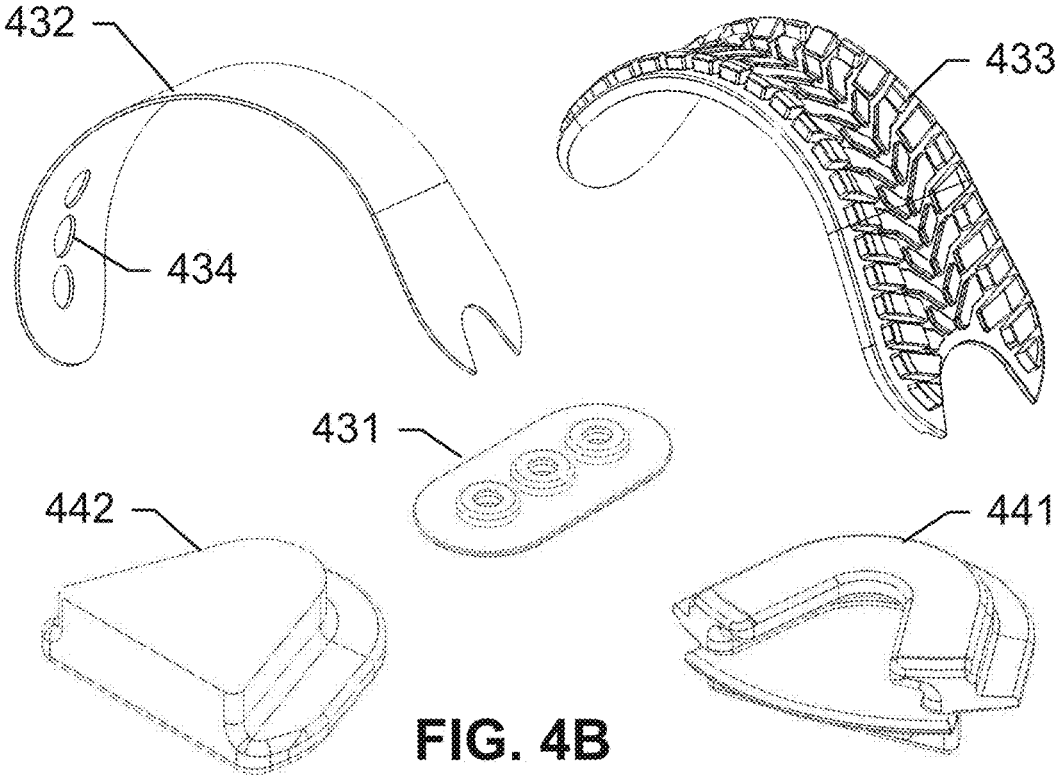

FIGS. 4A and 4B show a shoulder panel and its components, according to an exemplary embodiment of the subject disclosure. With reference to FIG. 4A, a fully assembled shoulder panel 430 may include a base 432, a coupling interface 431 for coupling to a rigid rear frame, a rifle pad 433, and an attachment point 441 for a backpack or other load. As described herein, the hardness of base 432 enables load transfer from a load attached to attachment point 441 towards the rear frame via a rigid coupling provided by coupling interface 431. For instance, coupling interface 431 may be used to bolt shoulder panel 430 to corresponding bolt holes in a rigid back frame. Coupling interface 431 may include other forms of attachment than bolt holes, such as male-female snaps, etc. These interfaces may be separate or a part of base 432. Further, rifle pad 433 may be a non-slip surface or pad adapted for providing friction to a rear end or stock of a rifle when in use. Rifle pad 433 helps cradle the rifle stock into its proper firing position whether the user is in a standing, kneeling, or pronate position. Despite being constructed of a hard or non-compressible material such as plastic, base 432 and rifle pad 433 may be sufficiently flexible to form a curve over a user's shoulder. Alternatively the materials for base 432 may be rigidly formed into a curve to fit over a user's shoulder.

Referring now to FIG. 4B, individual components of a shoulder panel include base 432 having bolt holes 434 on its back end and a coupling interface 431 for mating with bolt holes 434, with the numerous holes enabling a user to customize the fit of the vest to his or her torso. Shoulder panel 430 may further include a rifle pad 433. Moreover, each shoulder panel may comprise an attachment point 441 for enabling a backpack having compatible straps to be attached to it. For instance, attachment point 441 may be a female portion of a buckle that is adapted to receive a male portion 442. The female portion 441 serves the function of the attachment point and is coupled to a front end of base 432. The male portion 442 may be attached to a backpack strap or a similar load, and slides into female portion 441 when the strap or load is slung over a user's shoulder. Attachment point 441 can include a quick-release mechanism for quickly detaching the backpack from the vest, as further described herein. For instance, a male snap-fit may be added to a backpack strap, and the female end of the snap-fit is coupled to the shoulder pad. Upon strapping on the backpack, the user can insert male end 442 of the snap-fit into female end 441 to secure the backpack on the shoulders. When the load needs to be removed, the user may simply remove male member 442 from the female member 441, and slip off the backpack. Further, an upper surface base 432 and/or rifle pad 433 may be concave in its cross-section, or may have a groove cut out in it, thereby forming a channel for the shoulder straps of the backpack, and preventing the straps from slipping out. Such a curvature of the shoulder panel 430 as well as the hardness of the material distribute the load of a backpack across the shoulder, and keep the strap in the most ergonomic position.

Not shown in FIGS. 4A and 4B is a fabric panel that may be coupled to shoulder panel 430. The fabric panel may be used to house one or more components of the shoulder panel, or may simply be sewn or welded to a bottom surface of shoulder panel 430. Other couplings may be possible. For instance, Kevlar may be inserted into the shoulder panel 430. In either case, the fabric panel may include fabric strips or loops for coupling the shoulder panel to a chest panel. Further, the fabric panel may include channels or piping for one or more cables to be routed through the shoulder panel and between the front and back panels. For instance, a quick-release cable may be routed through a fabric loop coupled to shoulder panel 430 towards the back panel where the waist panels meet, and may be routed through the waist panels to keep the panels of the vest together. If and when the quick-release mechanism is released, this cable also loses tension and slips through the fabric channels or loops due to the weight of the panels and/or any load being carried. This releases the coupling of the shoulder panels with the waist panels, enabling the vest to fall apart quickly. This quick-release mechanism is described in further detail with reference to FIGS. 7 and 8. Moreover, a quick-retraction mechanism may include a cable that is routed from the spine extension through the shoulder panel and to a trigger on the shoulder panel or a chest panel.

Figure 5A:
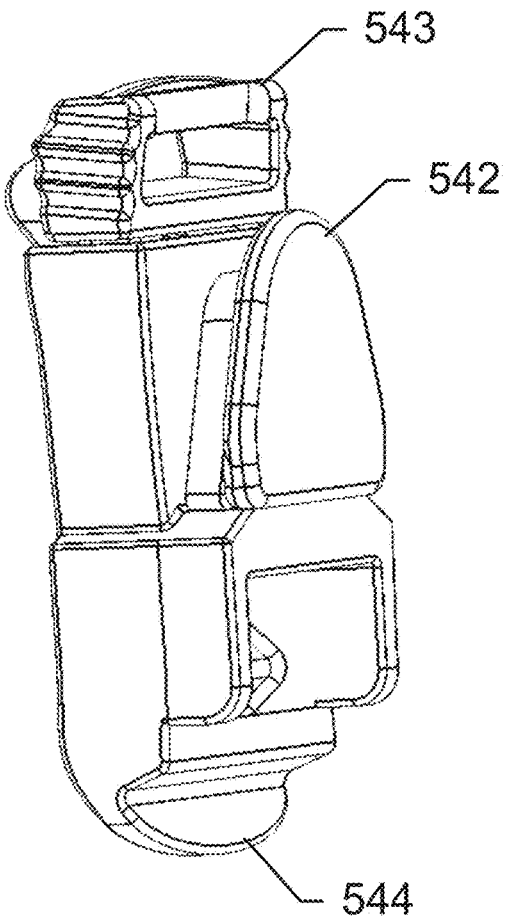
FIGS. 5A and 5B show a buckle assembly for coupling a backpack to a shoulder panel, according to an exemplary embodiment of the subject disclosure.
Figure 5B:
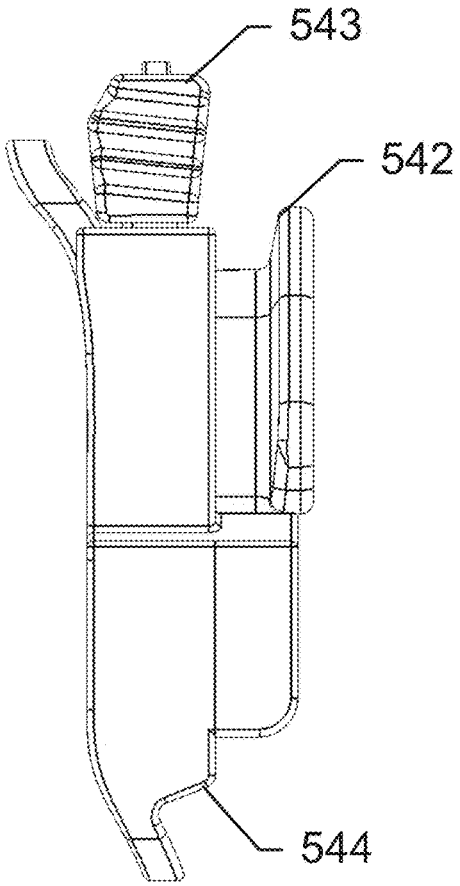

As described herein, existing backpacks may easily be modified to be able to couple to the attachment points of the shoulder panel. FIGS. 5A and 5B show such a modification, according to an exemplary embodiment of the subject disclosure. FIG. 5A shows a side view of a standard backpack buckle comprising a standard male portion 543 and a standard female portion 544. Further, a male portion 542 for coupling with a corresponding female portion of a shoulder panel may be securely affixed to one of portions 543 and 544 of the standard buckle. The standard buckle may be a part of an existing backpack, and includes any type of backpack buckle typically found on a backpack strap. For instance, the standard buckle may be a Dragonfly Mini that is manufactured by ITW Worldwide. For instance, the female portion of the buckle may be the ITW Snapdragon QR Buckle that is further described in European Patent EP2-12613B1, the contents of which are hereby incorporated by reference herein in their entirety. FIG. 5B shows a side view of the coupling of male portion 542 with a standard buckle comprising mating portions 543 and 544. Any backpack with a standard buckle may easily be modified with the addition of male portion 542, enabling the backpack strap to be coupled to the female portion on the disclosed shoulder panels, thereby transferring the load from the shoulder panels to the supporting waist belt as described herein.

Figure 6A:
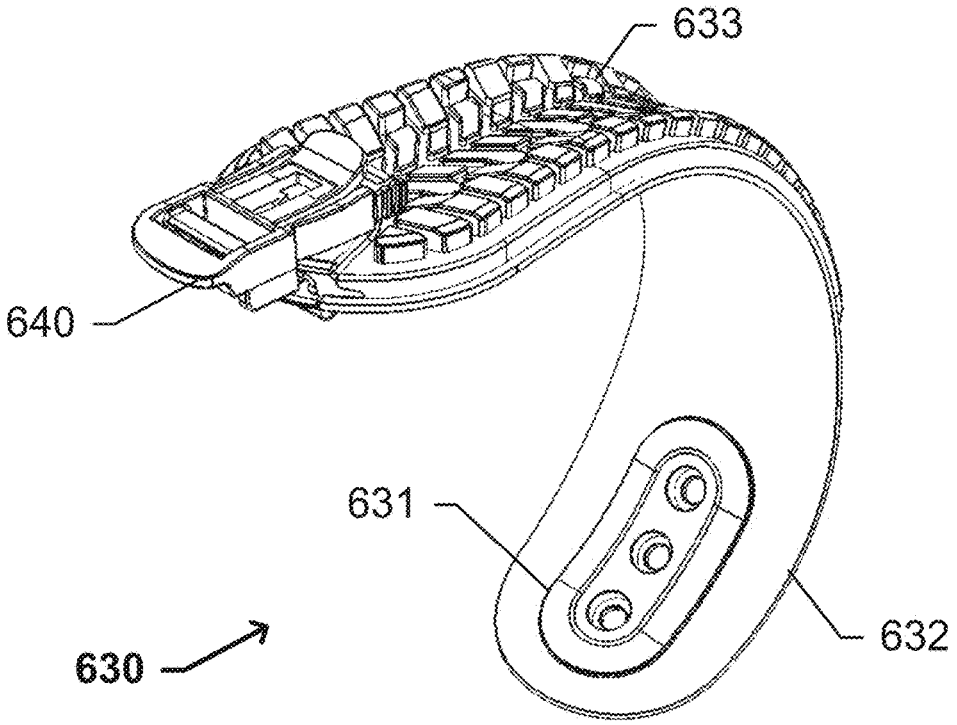
FIGS. 6A-6F show views of a shoulder panel incorporating a buckle assembly, according to an exemplary embodiment of the subject disclosure.
Figure 6B:
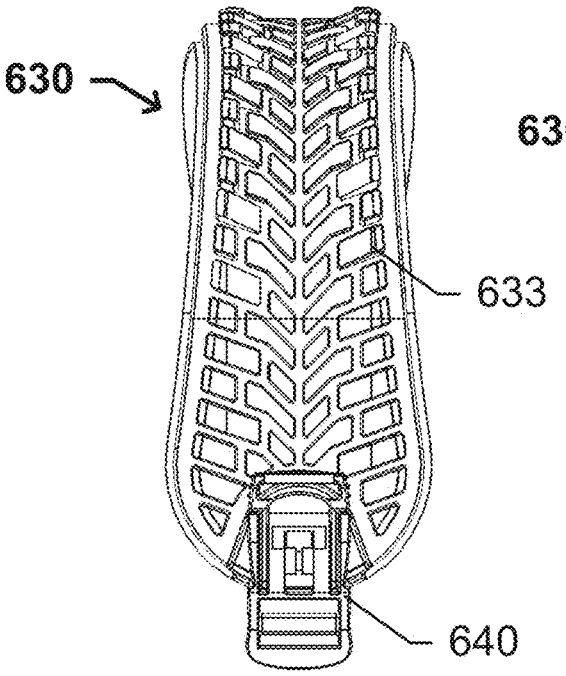
Figure 6C:
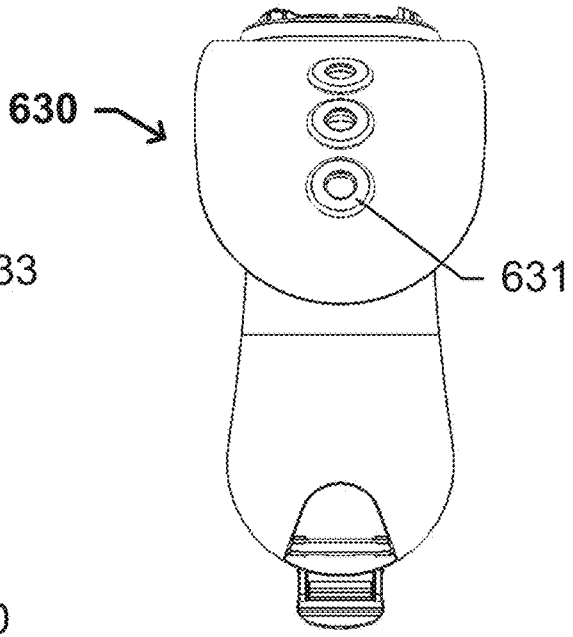
Figure 6D:
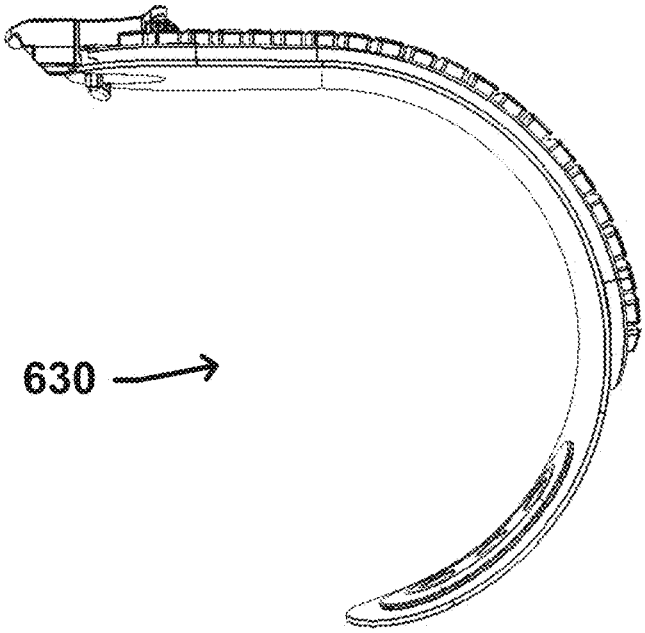
Figure 6E:
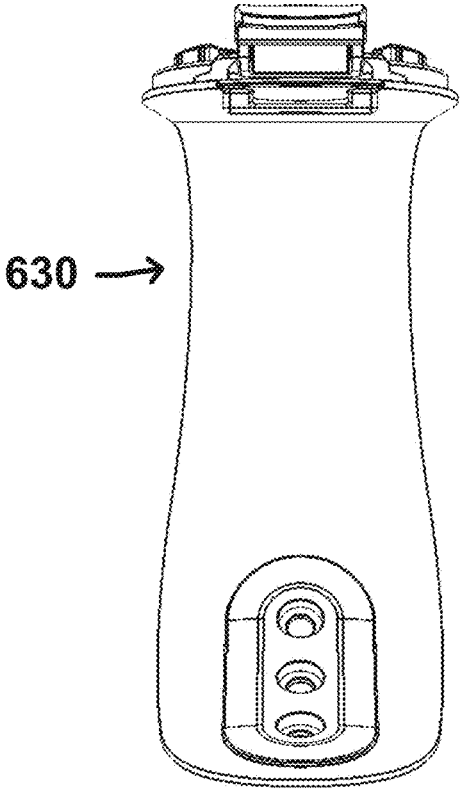
Figure 6F:
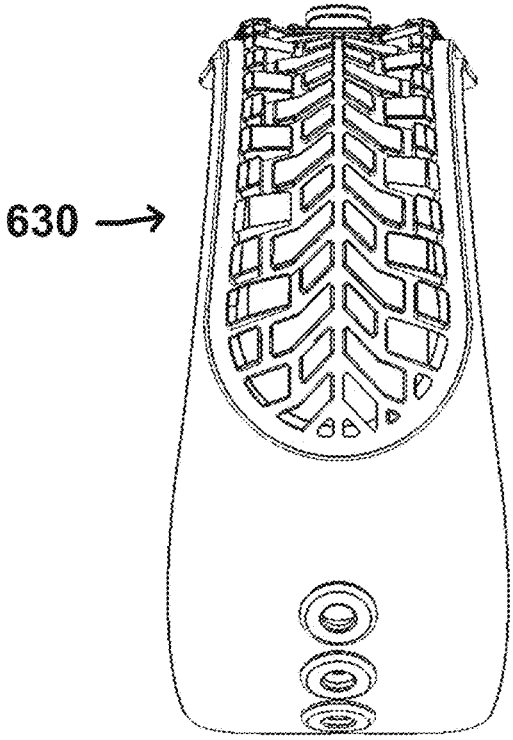

FIGS. 6A-6F show views of a shoulder panel having attached to it a standard buckle via the buckle assembly shown in FIGS. 5A and 5B. FIG. 6A shows an isometric view of a shoulder panel 630 comprising a base 632, coupling interface 631 at its rear end, rifle pad 633, and a buckle assembly 640 at its front end. With a standard buckle attached to buckle assembly 640, load is transferred through the base 632 to a rigid back frame via coupling interface 631. FIG. 6B shows a front view of shoulder panel 630. FIG. 6C shows a rear view of shoulder panel 630. FIGS. 6D, 6E, and 6F respectively show side, bottom, and top views of shoulder panel 630. In some embodiments, the standard buckle coupled to buckle assembly 640 may comprise a quick-disconnect mechanism. In such a case, a user may simply use the quick-disconnect mechanism to decoupled the standard buckle, such that the disconnected half of the standard buckle is pulled away from buckle assembly 640, thereby releasing the load from the user.

As mentioned above, the panels of the vest may be decoupled or disconnected from each other using one or more quick-release means. A quick-release cable may be routed through each panel, and through various connectors located at the end points of one or more panels, with the tension in the cable keeping the shoulder strap in place. The panels may be decoupled by pulling the cable through the panels, or by releasing the tension in the cable using a quick-release mechanism. The quick-release mechanism may be enclosed within a housing of the chest panel, and may be coupled to the quick-release cable.

Figure 7:
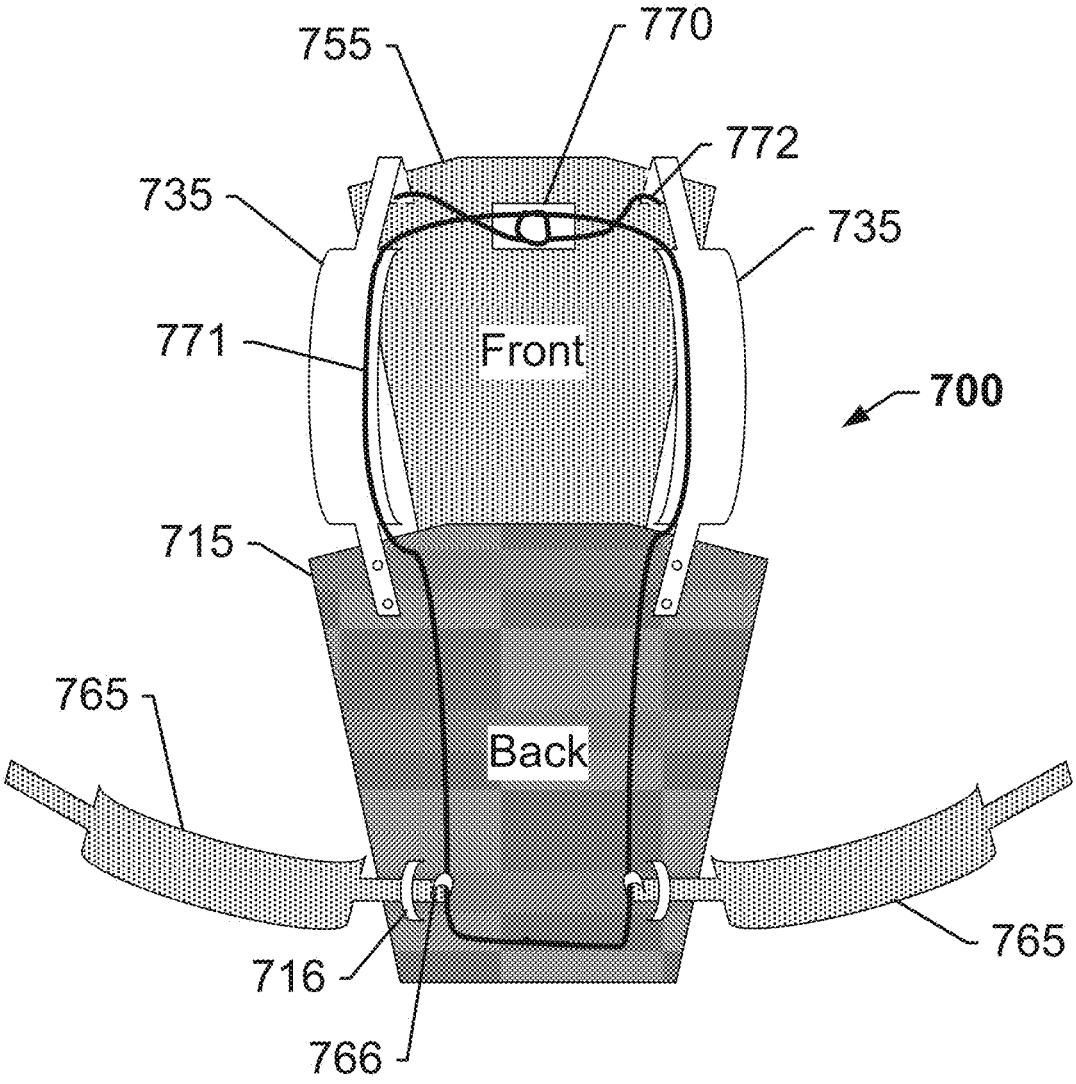
FIG. 7 shows a quick-release means for decoupling the panels of a vest, according to an exemplary embodiment of the subject disclosure.

FIG. 7 shows a quick-release mechanism for rapidly disassembling an upper vest 700, according to an exemplary embodiment of the subject disclosure. A plurality of panels of vest 700 is depicted in FIG. 7, including back panel 715, shoulder panels 735, front panel 755, and waist panels 765. Not shown but understood to be present are various additional features described herein, including pockets housing ballistic plates and Kevlar panels, and any components of the supporting mechanism, such as the rigid back frame, and shoulder panel components. This minimized perspective is shown simply to highlight the quick-release mechanism, which includes a quick-release cable housing 770 coupled to chest panel 755. Cable housing 770 houses one or more quick-release cables, such as cable 771 and 772. Cable 771 is routed through channels in both shoulder panels 735, across a surface of back panel 715, and through fabric strips 766 that are coupled to each waist panel 765. Cable 771 may alternatively be routed through only a single shoulder panel 735. Each fabric strip 766 is inserted through a fabric loop 716 that is sewn into or otherwise fixedly coupled to back panel 715. With cable 771 inserted through a channel in fabric strip 766, the tension in cable 771 prevents fabric strip 766 from being pulled through loop 716. The tension in cable 771 therefore keeps the waist panels 765 in place.

Further, each waist panel 765 includes means for attaching to chest panel 755. This may be a removable coupling, such as VELCRO strips that are arranged in several configurations, enabling waist panels 765 to be adjusted to differently-sized torsos. For instance, chest panel 755 may include several Velcro strips, enabling the front ends of waist panels 765 to be coupled to a user's choice of location. Moreover, chest panel 755 couples at its top end to a front end of each shoulder panel 735. This coupling includes fabric straps and loops similar to straps and loops 716 and 766. A quick-release cable 772 may be routed through fabric strips in the shoulder panel and/or the chest panel, with tension in cable 722 keeping the shoulder panels coupled to the chest panel. Further, each waist panel may further include a pocket for a Kevlar and/or a second pocket for a ballistic plate. A VELCRO loop within the pocket can hold the ballistic plate in place.

The chest panel 755 may include multiple housings for different components. For instance, multiple layers of fabric may be coupled by Velcro, and may be lifted to expose various components. In one example, the front end of each waist panel may be housed between two fabric layers of the chest, and held in place by Velcro strips. Further, a quick-release housing 770 may be positioned within chest panel 755 such that a user may easily operate the quick-release mechanism to release tension in cables 771 and 772. For instance, the panels may be decoupled by pulling the cable through the panels, or by releasing the tension via housing 770. The quick-release mechanism may be an independently constructed unit that is simply attached to housing 770 within the chest panel, via a Velcro strip, for instance. Moreover, any number of quick-release cables may be used. For instance, a single cable may be routed through all the attachment points on vest 700, rather than the two cables shown in FIG. 7. More than two cables may be used. Further, the chest panel may include a pocket for a Kevlar and/or a second pocket for a ballistic plate. A VELCRO loop within the pocket can hold the ballistic plate in place.

Figure 8A:
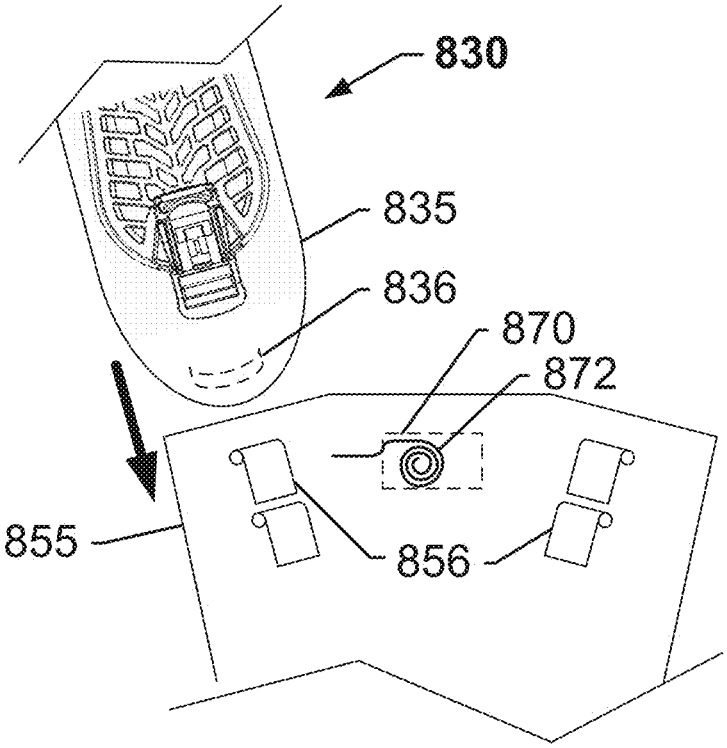
FIGS. 8A-8C show means for coupling panels of a vest using a quick-release cable, according to an exemplary embodiment of the subject disclosure
Figure 8B:
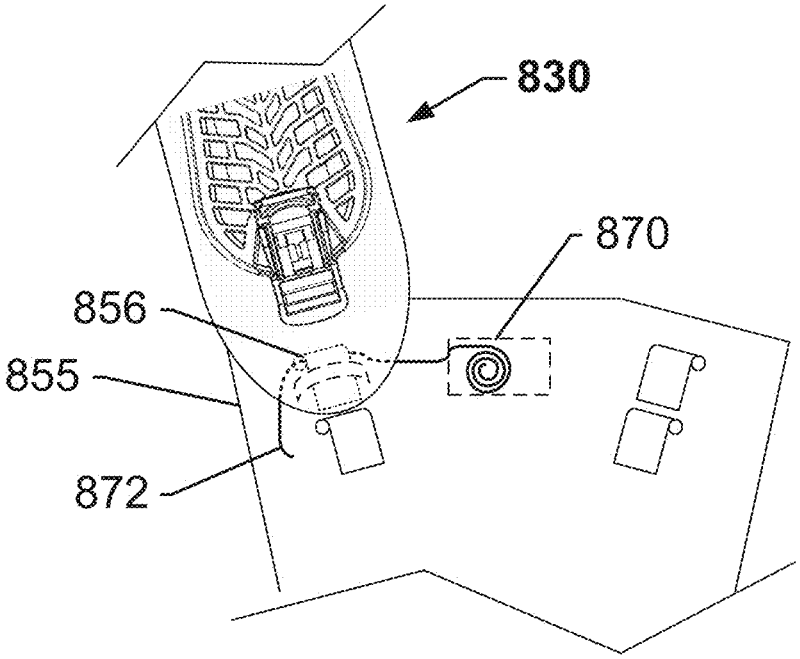
Figure 8C:
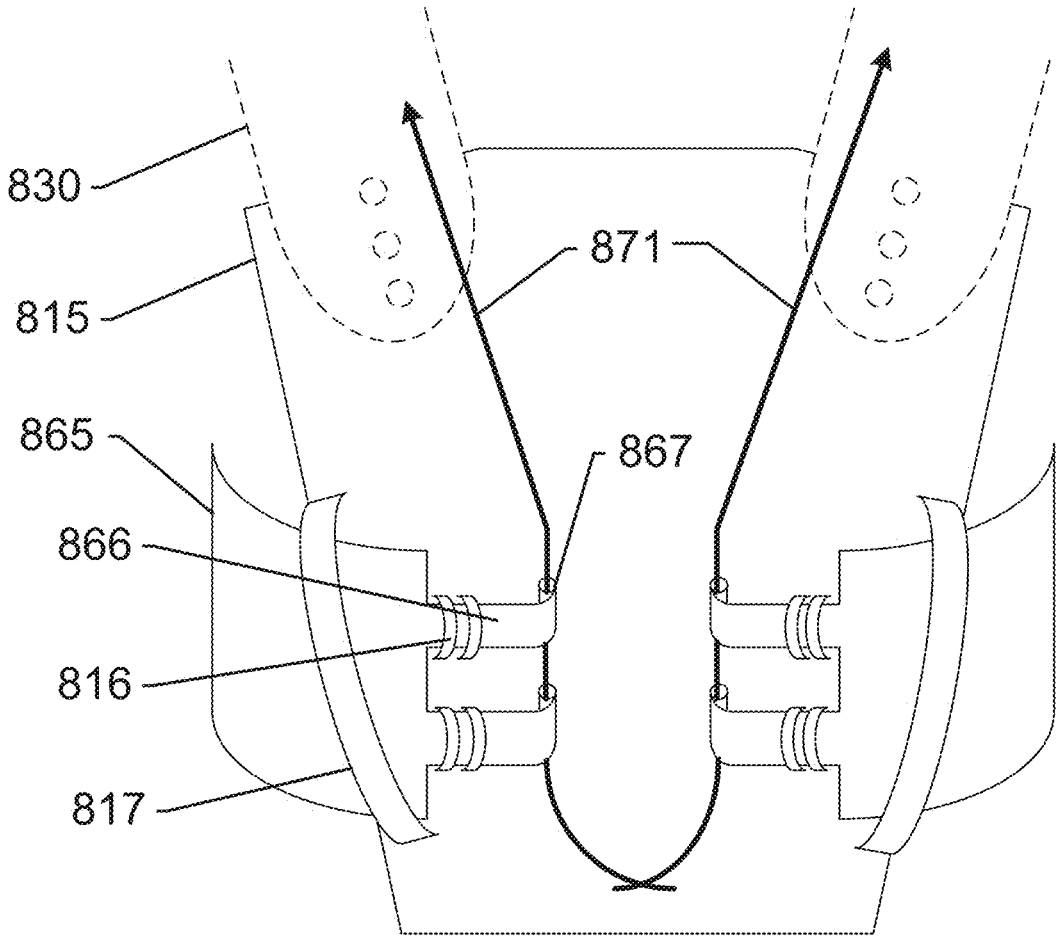

FIGS. 8A-8C show how various panels of the vest are coupled together with quick-release mechanisms, according to an exemplary embodiment of the subject disclosure. FIGS. 8A-8B show a shoulder panel 830 including a fabric panel 835 being coupled to a chest panel 855. During construction, a fabric loop 836 may be sown, welded, or otherwise attached to fabric panel 835. Fabric loop 836 is adapted to receive a fabric strip 856 that is affixed to chest panel 855. A plurality of fabric strips 856 may be provided, enabling users having differently-sized torsos to choose different fabric strips 856 to couple with fabric loop 836. The loops 836 may instead be plastic, and built into attachment points on the shoulder panels to facilitate weight transfer. Moreover, fabric strips 856 may include adjustable straps such as 766 in FIG. 7, using VELCRO to adjust the length for instance.

With reference to FIG. 8B, shoulder panel 830 is lowered and one of fabric strips 856 may be inserted into and through fabric loop 836. Fabric strip 856 includes a channel for receiving a quick-release cable 872, the channel being positioned transverse to the length of the strap. Quick-release cable 872 may be extended from housing 870 coupled to chest panel 855, and inserted through the channel in fabric strip 856 and bent on one side at a 90 degree angle to hold it in place. Quick-release cable 872 prevents the fabric strip of the chest panel from sliding out of the fabric loop of the shoulder panel, thereby maintaining the connection between both panels. When the quick-release mechanism is released, for instance by exposing the housing 870 and releasing the tension in cable 872, the weight of the vest and/or any accompanying load pulls the shoulder panels away from the chest panel as the cable slides through the loops, thereby disengaging the panels and letting the user be independent of his or her load. Other embodiments for releasing the cable 872 are within the purview of this disclosure, such as a short-distance pull-to-disconnect mechanism that eliminates the need to retrace the cable through the panels after disconnection.

Further, as described herein, each waist panel has a first connecting means, such as Velcro on one side (loop on one surface, hook on the other) for connecting with the front plate, and a second connecting means on the other side for connecting with the other waist panel. The second connecting means may include one or more fabric loops for engaging with corresponding fabric loops on another panel, with the loops being held in place by a tensioned quick-release cable. With reference to FIG. 8C, waist panels 865 may include fabric straps 866 that are adapted to be inserted through fabric loops 816 and 817. Fabric loops 816 and 817 are fixedly coupled to a fabric back panel 815 that encloses components that are not shown such as a back frame and spine extension. Correspondingly, a coupling of shoulder panels 830 with back panel 815 is assumed via the rear frame that is not shown. A quick-release cable 871 may be routed from a quick-release mechanism in the chest panel, through shoulder panels 830 as described herein, and through narrow channels or loops 867 in fabric strips 866. The cable 871 may run past the connection with 867 and bend 90 degrees and fold into a pocket. This pocket may be open on both sides and either side of cable 867 may enter the pocket from opposite sides and slightly overlapping inside the pocket. These pockets are made of fabric trap sewn horizontally to 815 on top and bottom allowing the cables to enter from either side. Cable 871 prevents waist panels 865 from being disengaged from back panel 815. A similar coupling exists for the both waist panels. Upon releasing the tension in cable 871, waist panel 865 may be pulled away from back panel 815 by virtue of its weight or a load, thereby disengaging the vest from the user, and enabling the user to move freely.

If a tension plate is coupled to the waist panel, the tension plate may be coupled to the fabric strips, and therefore the combination of the tension plate and the fabric strips may be inserted through the loop in the back panel. The back panel may comprise a plurality of loops at various locations, enabling a user to select the loop that ensures the most comfortable fit for the user. The coupling of the waist panels with the back panel is clearly visible in the exemplary fine adjustment mechanism described with respect to the embodiment depicted in FIG. 9. As described herein, during initial assembly, the various connecting means for connecting the vest panels may include adjusting means enabling the vest to be worn by users having differently-sized torsos, such as differently-spaced Velcro strips and fabric loops. In some exemplary embodiments, the vest also includes a second adjustment means for making small adjustments when the vest is fully assembled. For instance, a tension cable may be routed from an adjusting means housed in one waist panel, through a fixed cable housing in the waist panel to a back end of the waist panel, and connecting the waist panel to the back end of the other waist panel. An advantage of the fine adjustment means is that Velcro coupling or other means currently known in the art need not be adjusted. This has benefits in tactical combat situations, for example when a silent adjustment needs to be made.

Figure 9:
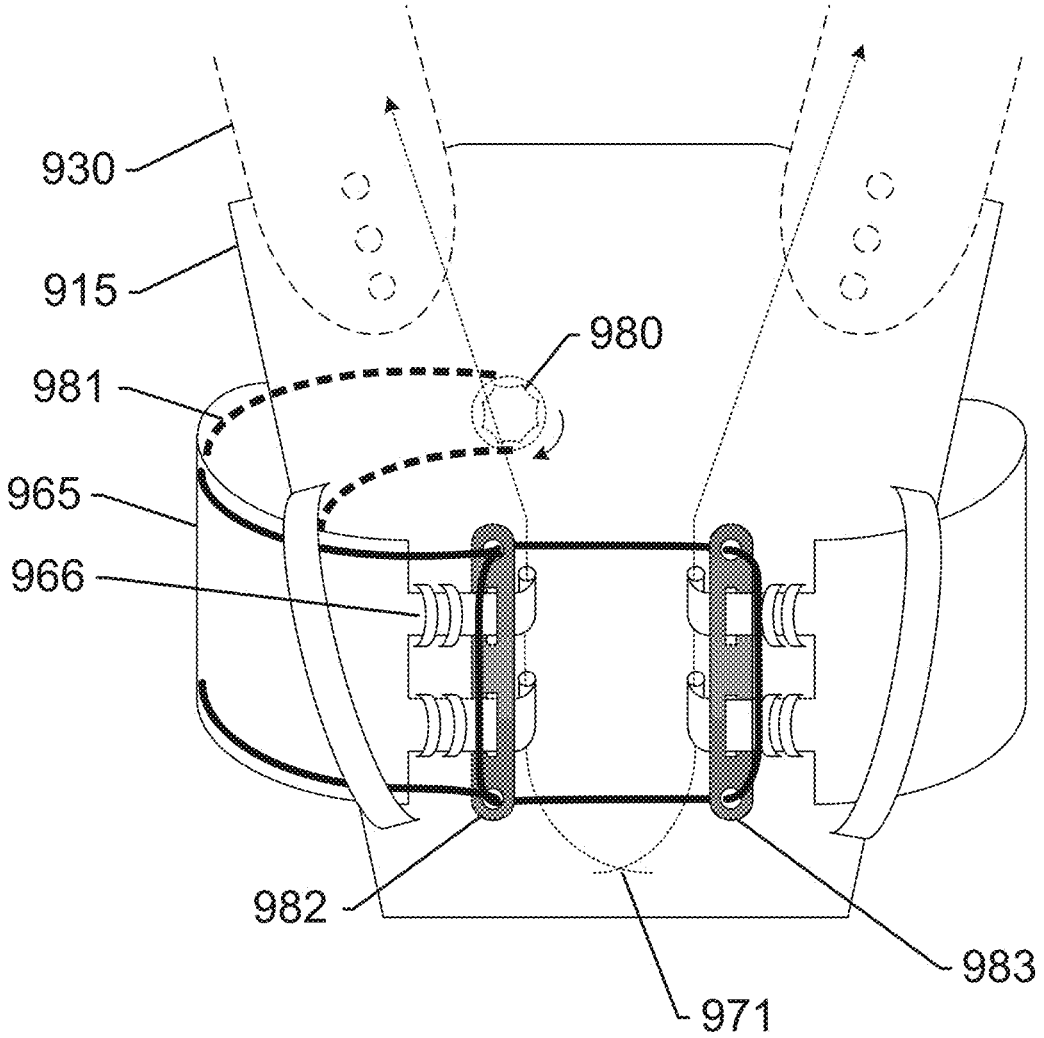
FIG. 9 shows a fine adjustment means for adjusting a tightness of the vest around a waist, according to an exemplary embodiment of the subject disclosure.

With reference to FIG. 9, a tension cable 981 may be routed from an adjusting means 980 housed near the front end of waist panel 965, through a fixed cable housing or channel in waist panel 965 and through a pair of vertically aligned tension plates 982 and 983 that are respectively coupled to a rear end of each waist panel. The tension cable 981 is routed through both tension plates 982 and 983, connecting them, and evenly distributing the tension between each plate. The tension plates include slots for receiving fabric strips 966 that are coupled to each waist panel 965, as shown in FIG. 8C. With the combination of quick-release cable 971 holding the waist panels in place, and tension plates 982 and 983 being coupled to both fabric strips 966 and tension cable 981, as the adjusting means 980 is tightened, the tension plates are pulled towards each other. As the tension plates are pulled towards each other, the waist panels are also pulled closer together, thereby tightening around a waist of a user. The tension plates 982 and 983 pull each waist panel evenly, thereby uniformly distributing the tension around a user's waist. By manipulating adjusting means 980, the user may vary the length of the tension cable to adjust a spacing between the tension plates, thereby adjusting the fit of the vest. For instance, tightening adjustment means 980 increases tension in cable 981, pulling the tension plates 982 and 983 together, and tightening the panels around the waist. Loosening adjustment means 980 decreases tension in cable 981, creating more distance between tension plates 982 and 983, thereby loosening the vest around the waist. The adjustment means 980 may include a reel such as the Boa Technologies reel described in U.S. Pat. No. 7,950,112, the contents of which are hereby incorporated by reference herein in their entirety.

Figure 10A:
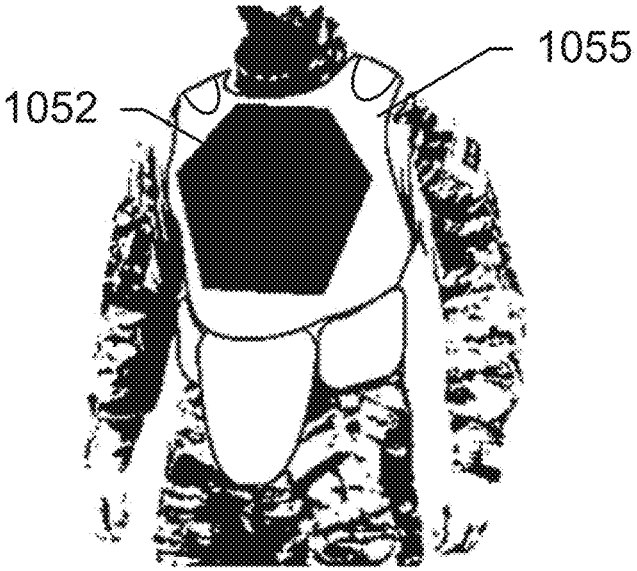
FIGS. 10A-10C show arrangements of ballistic plates in an assembled vest, according to an exemplary embodiment of the subject disclosure.
Figure 10B:
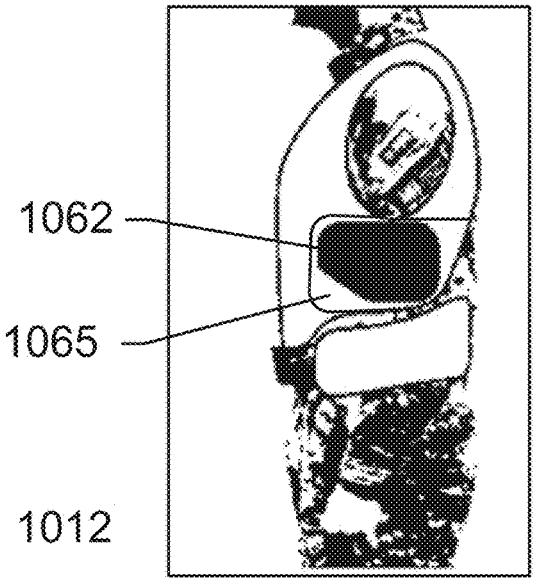
Figure 10C:
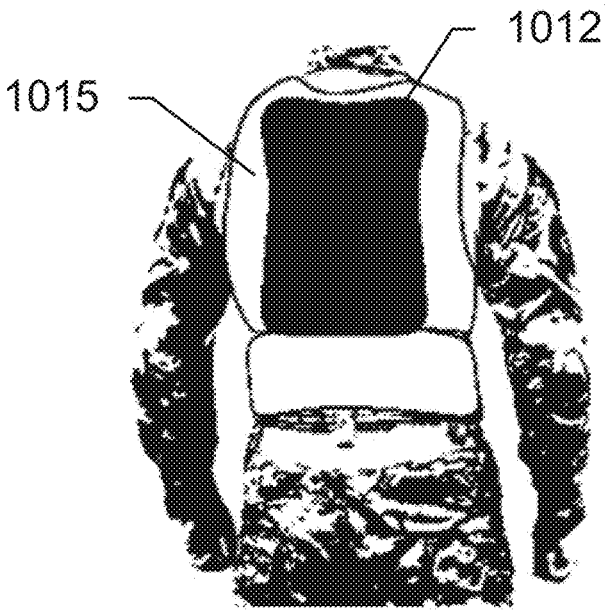

FIGS. 10A-10C show exemplary locations of ballistic plates encased within fabric panels of a vest, according to an exemplary embodiment of the subject disclosure. The vest in FIGS. 10A-10C is shown in a fully assembled state, and it may be assumed that the various panels are overlapping each other, with each panel including one or more pockets for housing ballistic plates and other components. For instance, FIG. 10A shows a ballistic plate 1052 housed within a chest panel 1055. FIG. 2B shows a ballistic plate 1062 housed within a waist panel 1065. FIG. 2C shows a ballistic plate 1012 housed within back panel 1015. Each plate may be securely fastened within a panel using VELCRO® or equivalent fasteners such as hook-and-loop, zippers, etc. The ballistic plates may be held within a pouch in each panel. A plurality of panels of varying sizes may be sewn or welded into each fabric panel for housing one or more ballistic plates, Kevlar sheets, etc. For instance, a pocket closer to the user's torso may house a Kevlar sheet, while a pocket further away from the user's torso may house a ballistic plate, enabling the Kevlar sheet to protect against shrapnel generated from a projectile hitting the ballistic plate. A position of each ballistic plate may be adjusted by VELCRO loops within the storage pockets. As shown in FIGS. 10A-10C, strategically dividing the ballistic plates provides increased torso flexibility and allows freedom of movement without compromising protection. The divided body armor design will provide better torso flexibility and allow for less restricted movement without compromising protection like existing plate carriers. Further, this design has minimal impact to ballistic fabric layout and ballistic plate locations. The ballistic plates encased by the fabric panels may meet the standards of the National Institute of Justice (NIJ) level IV. The examples shown in FIGS. 10A-10C are simply examples of placement of ballistic plates, and the subject disclosure is not limited to this embodiment—other arrangements may be conceived of by those having ordinary skill in the art in light of this disclosure.

Figure 11:
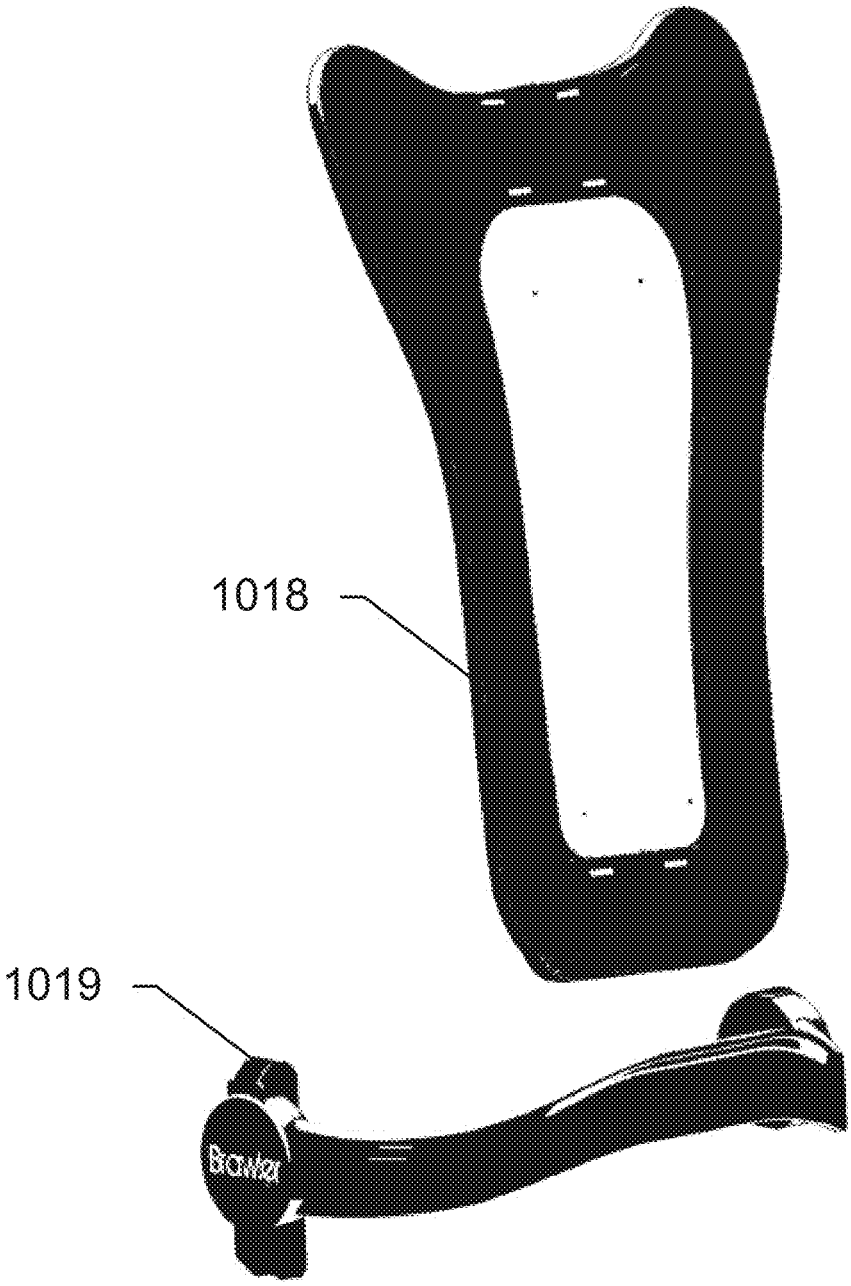
FIG. 11 shows an alternate back panel and supporting belt combination, according to an exemplary embodiment of the subject disclosure.

FIG. 11 shows an alternate rear frame and supporting waist belt, according to an exemplary embodiment of the subject disclosure. Rather than use a spine extension, rear frame 1018 is designed to be of a length sufficient to make contact with a cradle of supporting waist belt 1019. Despite not having a spine extension, this embodiment continues to serve the function of providing support when needed and, upon movement of the torso, decoupling of frame 1018 from belt 1019, providing torso flexibility on demand.

According to an exemplary embodiment of the subject disclosure, the rigid back frame includes a rigging system or a rack system, enabling a user to carry additional equipment on the vest, such as a radio, battery, etc. The rigging or rack system is adapted to hold the weight of this equipment and any additional items that users may hard-mount onto the vest. The user may attach a piece of equipment to their body armor prior to a mission and use of the vest. The equipment may include radios, batteries, or other heavy solid objects that could simply be bolted or strapped to this rigging system.

Figure 12A:
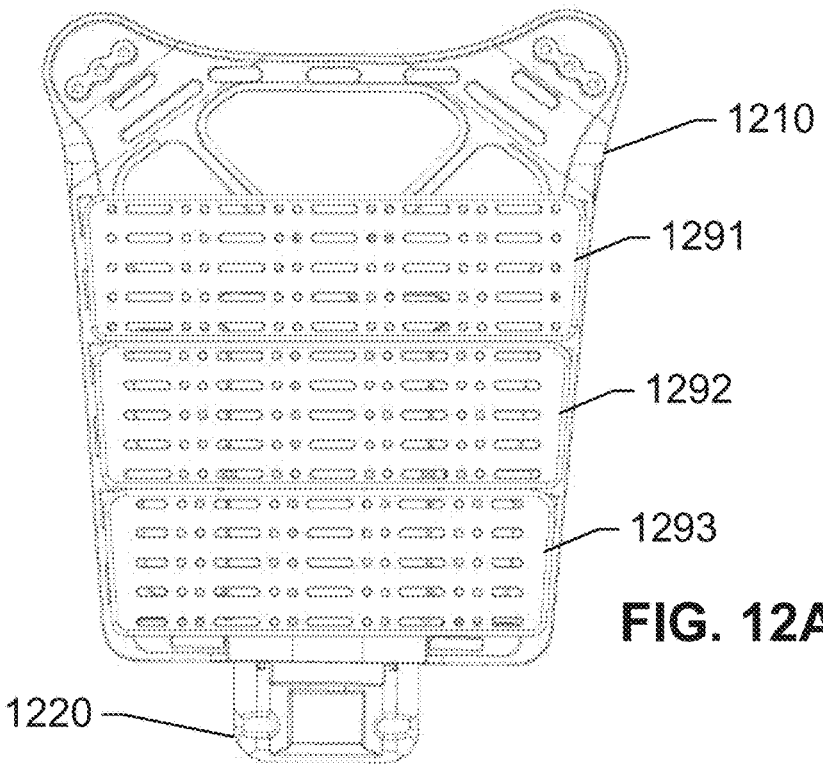
FIGS. 12A and 12B show a rigid back frame holding a plurality of racks, according to an exemplary embodiment of the subject disclosure.
Figure 12B:
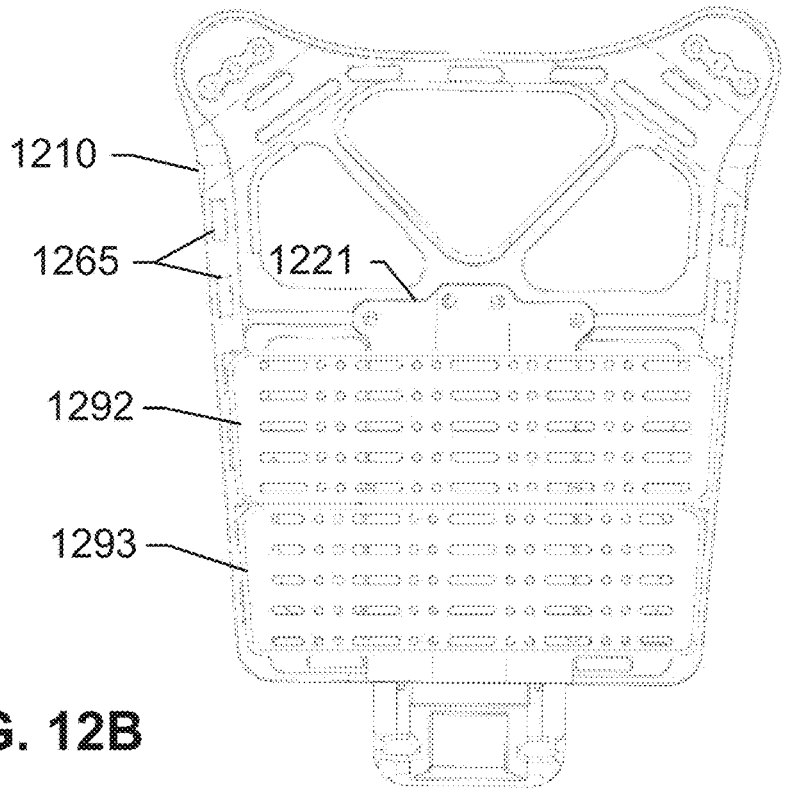

FIGS. 12A and 12B depict a rigid back frame 1210 holding a plurality of racks 1291-1293, according to an exemplary embodiment of the subject disclosure. Each of the three racks 1291, 1292, and 1293 are appropriately-sized based on the location that they are mounted on to rigid back frame 1210. For example, a top rack 1291 is slightly wider than middle rack 1292, which in turn is slightly wider than the narrowest rack 1293. The racks can each be used individually, or coupled together as a group. Each rack may be removable. For example, each rack may slides into rails going down each side of frame 1210, and may be exposed by opening the fabric (not shown) that may be covering frame 1210 or the entire vest assembly. For example, FIG. 12B shows a rigid back frame 1210 with only the lower two racks 1292 and 1293, since rack 1291 was removed, thereby exposing the housing 1221 for a spine extension 1220. The racks may include elongate members that slide into slots 1265 provisioned on frame 1210. Detail on the elongate members sliding into the slots is further shown in FIGS. 13A-13C.

Figure 13A:
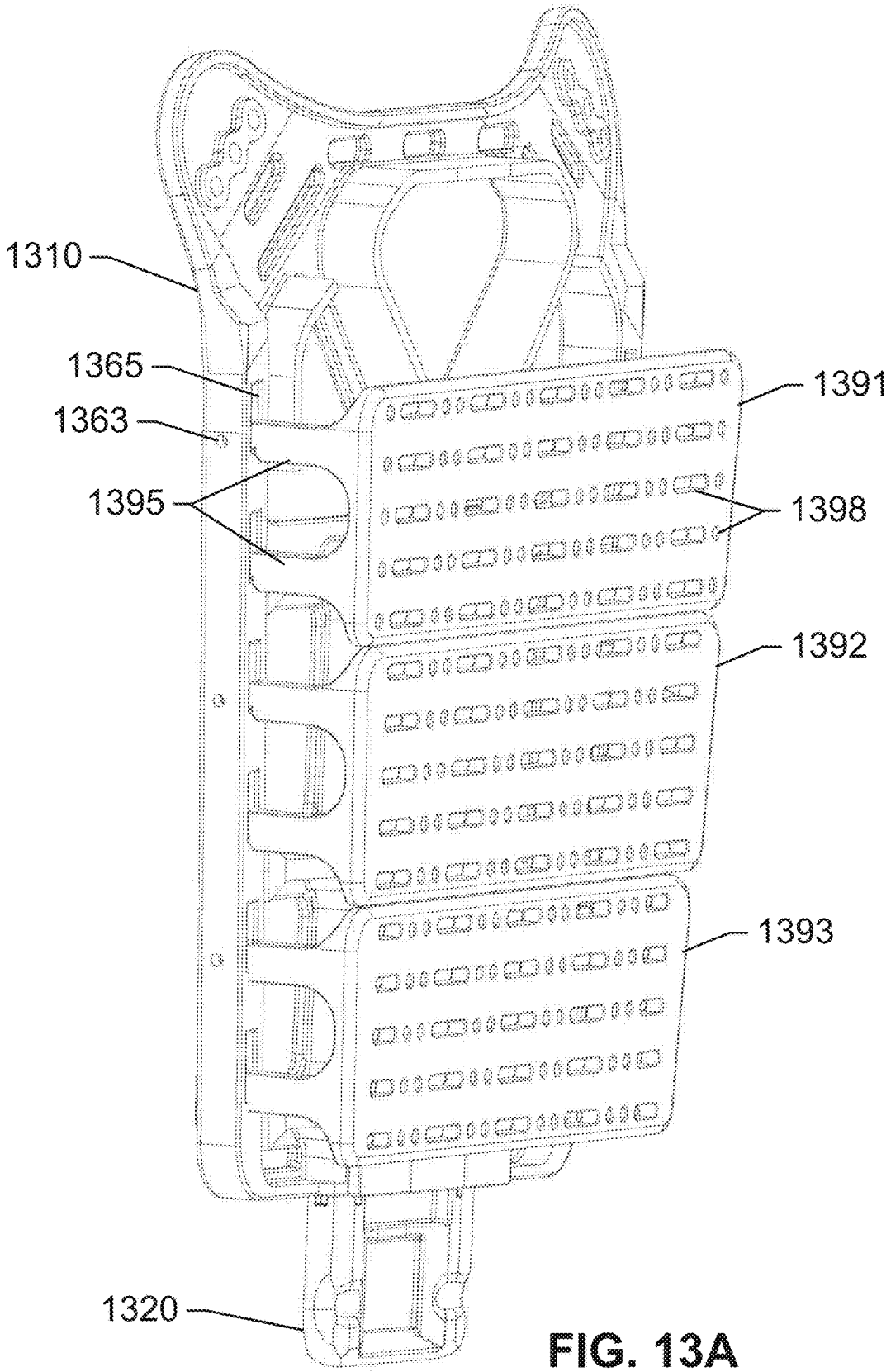
FIGS. 13A-13C show a perspective view of removal of a single rack, according to an exemplary embodiment of the subject disclosure.
Figure 13B:
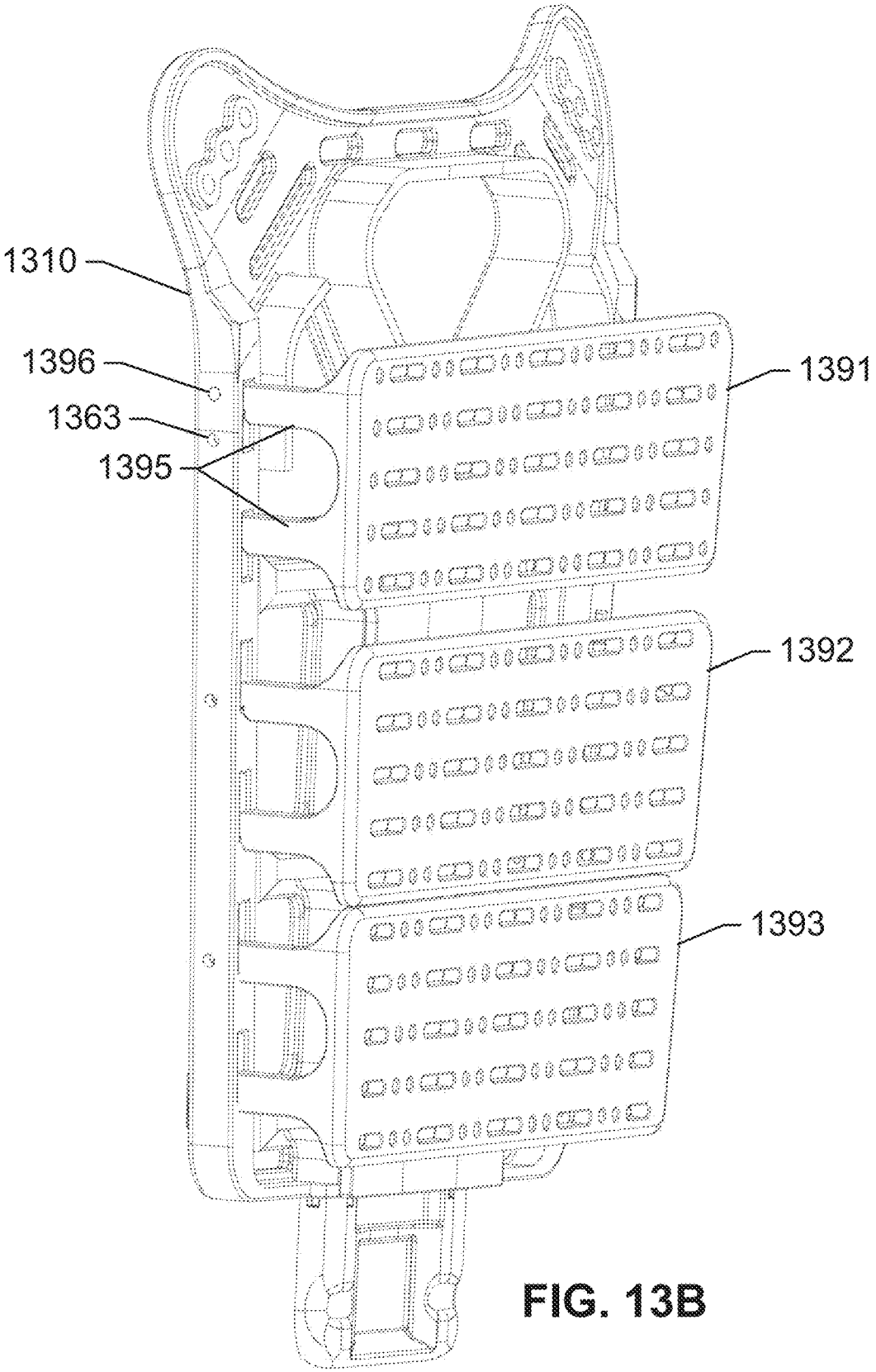
Figure 13C:
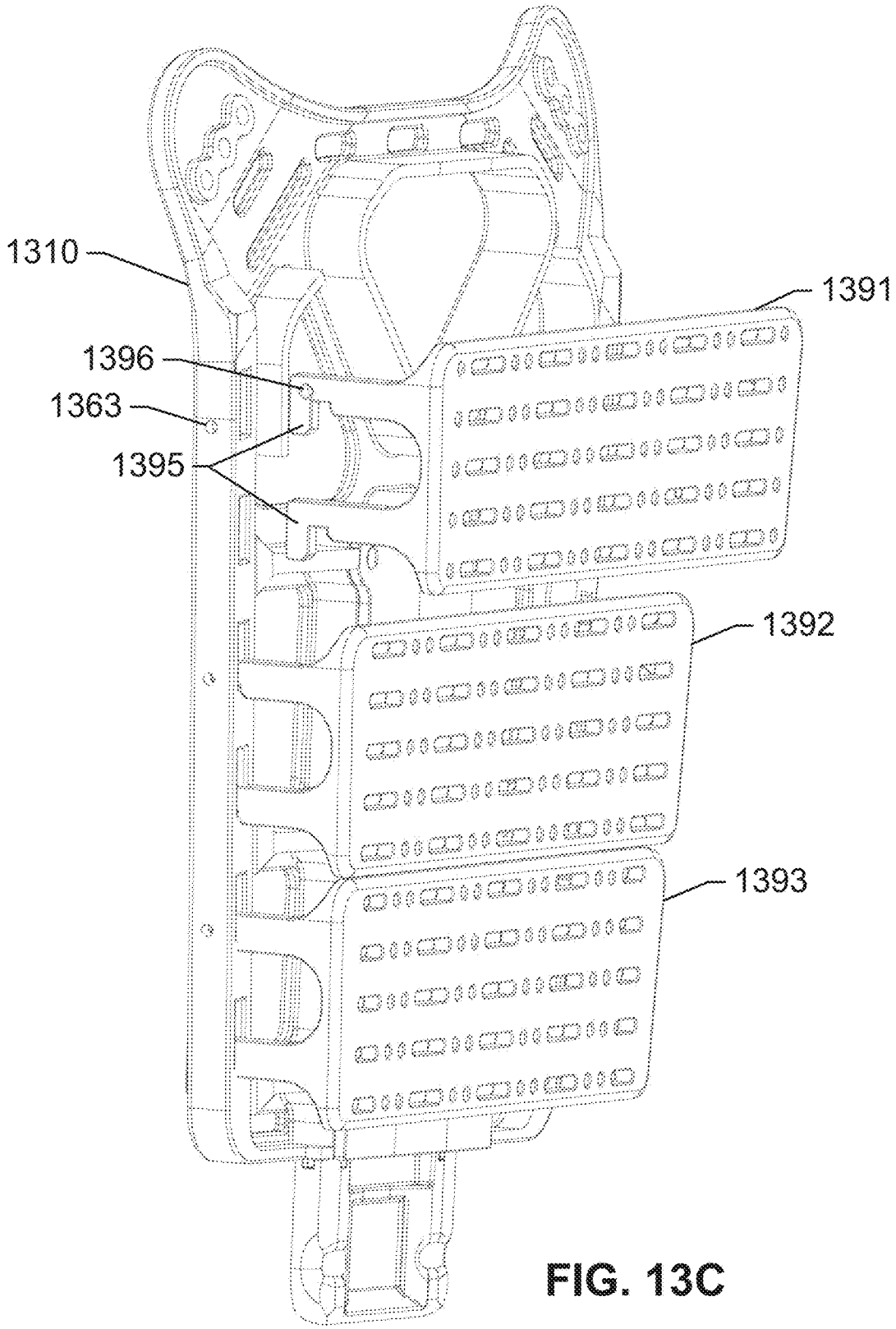

FIGS. 13A-13C depict a perspective view of removal of a single rack 1391, according to an exemplary embodiment of the subject disclosure. Racks 1391-1393 are attached to rigid back frame 1310 via a combination of elongate members 1395 for each rack, that slide into corresponding slots 1365 provided within rigid back frame 1310. Moreover, bolt holes or cable holes 1363 may be used to align the rack. For example, with respect to FIG. 13B, a rack 1391 may include elongate members 1395, at least one of which may have a hole 1396 that is adapted to align with hole 1363 in frame 1310. Once holes 1396 and 1363 are aligned, as shown in FIG. 13A, a bolt may be inserted into the holes along with a nut adapted to hard mount the rack 1391 to frame 1310. Alternatively, a cable may be passed through the aligned holes, wherein the cable runs up frame 1310 to a "pull point" that quick-releases the racks. Any location for the "pull point" may be provided, for example at the top or bottom of frame 1310. The quick-disconnect mechanisms described herein may be adapted to also pass through holes 1363 and 1396, enabling easy unloading of the racks. FIG. 13C shows rack 1391 completely removed from frame 1310. Bolt hole 1396 is drilled into at least one of elongate members or tabs 1395 coupled to rack 1391, and is aligned with bolt hole 1363 when the rack 1391 is fully inserted into slot 1361 and pushed down to align the holes, as shown in FIGS. 13A and 13B.

Moreover, each rack 1391-1393 may have a series of holes and/or slots that are used to bolt, clamp, or strap on the additional equipment described herein. For example, FIG. 13A depicts holes and slots 1398 in each rack 1391, 1392, and 1393. Therefore, additional equipment may be added in any configuration. Further, each rack bridges over the protective Enhanced Small Arms Protective Insert (ESAPI) or other ballistic plates, so that the racks do not compromise the ballistic integrity of the plates. Further, the plates need not be removed when adding or removing a rack.

Figure 14A:
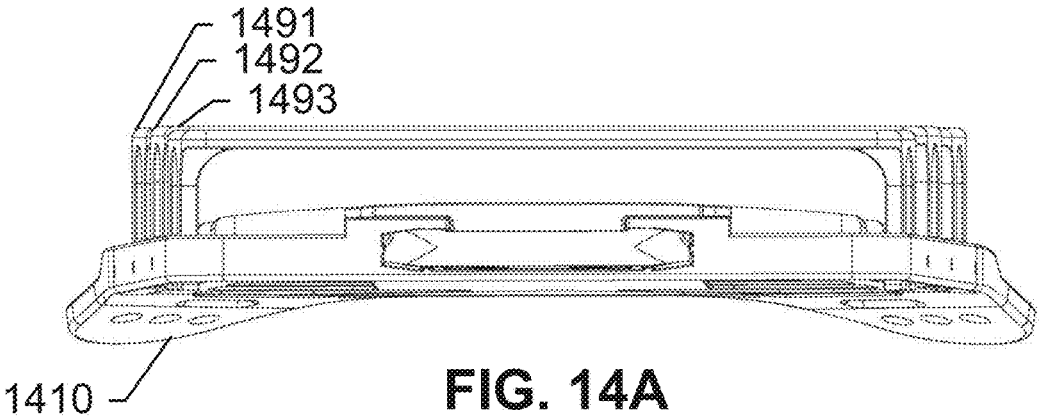
FIG. 14A-14C show different views of a rigid back frame and racks, according to an exemplary embodiment of the subject disclosure.
Figure 14B:
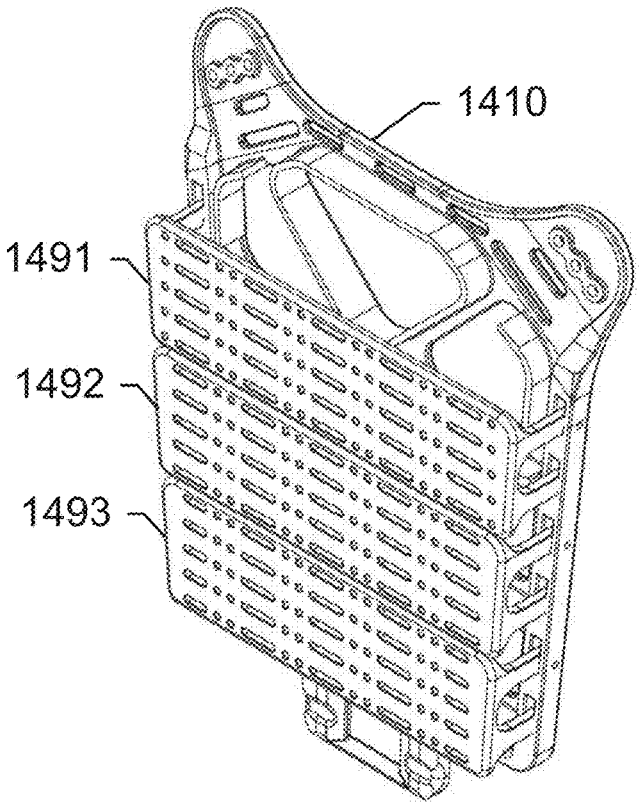
Figure 14C:
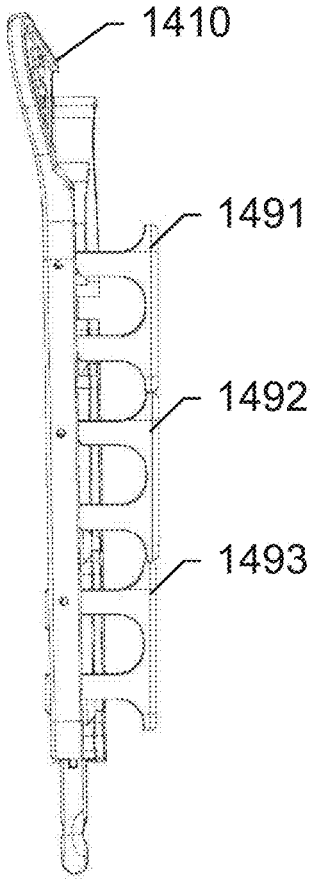

FIG. 14A-14C depict different views of a rigid back frame 1410 and racks 1491-1493, according to an exemplary embodiment of the subject disclosure. FIG. 14A depicts a bottom view of frame 1410, showing a spacing between racks 1491, 1492, and 1493, and frame 1410. This spacing allows for ESAPI plates to remain in place. FIG. 14B shows a perspective view of frame 1410 and racks 1491-1493. FIG. 14C shows a side view of frame 1410 and racks 1491-1493.

There are several novel concepts described herein that may transcend the various embodiments shown herein, yet are within the inventive spirit of the subject disclosure, and offer numerous advantages. For instance, the disclosed frameworks ergonomically transfer pack and combat loads past the spine onto the waist, reducing compaction of the spine, alleviating much of the upper body fatigue and injuries associated with heavy load-carrying. The separation of the upper vest structure with the adjustable extension to the waist belt enables torsional flexibility on demand. For instance a user may simply lean forward, extend the spine extension, and lean back to cradle the extension within the supporting waist belt. A low, smooth profile in the supporting waist belt keeps from impacting a user's movements and is adjustable to the user's needs. The supporting waist belt provides a stable connection between the spine structure and the waist. The upper concave form cradles the lowered spine extension allowing for normal upper body movement. When the extension is raised, the low profile has a minimal profile to lower the probability of impairing a user's movement.

The quick-release mechanism combined with the non-fixed backpack attachment enables users to easily place weight on their waist, remove it, quickly access vital equipment and return it with minimal change to typical pack usage. The attachment's obtuse opening allows for easy connection and removal of male buckle. The connection may be a snap-fit connection, with the male portion capable of being added to most United States Government Issue (USGI) and other backpacks. Once the connection is made, an over the shoulder adjustment allows the users to transfer weight to the back structure. In a life threatening scenario the quick-disconnects can be pulled to release the pack from the user. With the pack secured properly to users, their ability to carry mission essential equipment will no longer hinder their movements, and will decrease their rate of fatigue.

The rifle pad attached to the shoulder panel serves multiple purposes. It disperses the impact of a rifle kick over a wider portion of the shoulder, yet cradles the rifle's buttstock in a manner that supports quick sight composer. The interior channel centers a pack's straps, preventing movement. The pad also transfers weight over the user's shoulder to the spine structure and to distribute the remainder of the weight across a wider portion of the shoulder, thereby decreasing extremity fatigue.

The simple cable system that connects the two waist panels together inside the back panel enables precise adjustments with the twist of a reel. The adjustment reel is located below the front ballistic plate so it can effortlessly be accessed with a free hand. The abdomen is the most commonly adjusted area of a vest and traditionally requires the use of both hands and upwards of a minute to adjust. With the disclosed mechanism, the circumference of the abdomen can quickly be adjusted to the user's needs. Moreover, if a metal cable is used, the fabric attachments including loops and strips may be elasticized to allow for abdomen and chest expansion.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents. For instance, the load-bearing system may further comprise a hard mount system/rack for enabling large rigid items such as batteries, radios, extra ammo, etc. to be removable or permanently attached to the vest. Vertical channels may be built into the sides of the frame that comprise female notches for allowing an easy removal and release system. Moreover, the rapid disassembly mechanism may include a socket-type attachment for convenient re-assembly and a shorter "pull" distance for disengagement, in case the user is confined within a small space. Further, the spinal extension may have a preset height such that users may affix it when they first get the vest, and may subsequently be able to make minor changes on the go. The abdominal section may be similarly adjustable. In addition, the attachment points on the chest between the shoulder pieces and the front and back panels may include some form of a single strap with Velcro for length adjustment. Finally, an injured user carrying system a.k.a. a litter may be included within the vest.

Further, in describing representative embodiments of the present subject disclosure, the specification may have presented the method and/or process of the present subject disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present subject disclosure should not be limited to the performance of their steps in the order written, and one skilled in the art can readily appreciate that the sequences may be varied and still remain within the spirit and scope of the present subject disclosure.

What is claimed is:

1. A system for transferring a load to a user's hips, the system comprising:

a pair of curved shoulder panels;

a rigid back frame coupled at its top end to the pair of curved shoulder panels; and a supporting waist belt comprising a cradle;

wherein a load on the pair of curved shoulder panels is transferred to the supporting waist belt when the rigid back frame rests on the cradle; and wherein a quick-release cable is routed through a channel in a fabric strip fixedly coupled to the supporting waist belt, the fabric strip being inserted through a corresponding fabric loop fixedly coupled to a back panel housing the rigid back frame.

2. The system of claim 1, wherein the rigid back frame comprises a spine extension that is adapted to fit within the cradle.

3. The system of claim 2, wherein the spine extension is extendable in a direction towards the cradle.

4. The system of claim 2, wherein the spine extension is retractable via a spring-loaded mechanism.

5. The system of claim 1, wherein each of the pair of curved shoulder panels comprises at its front portion an attachment point for enabling the load to be attached.

6. The system of claim 5, wherein the attachment point includes a female buckle adapted to slidingly engage a male buckle that is attached to the load.

7. The system of claim 6, wherein the load includes a strap coupled to the male buckle, and wherein the strap sits on a top surface of at least one of the pair of curved shoulder panels.

8. The system of claim 7, wherein an upper surface of each of the pair of curved shoulder panels comprises a groove for preventing the strap from slipping off the shoulder panels.

9. The system of claim 1, wherein the rigid back plate and the pair of shoulder panels are each coupled to a corresponding fabric panel, each fabric panel including one or more coupling means for coupling to one or more additional fabric panels.

10. The system of claim 9, wherein the corresponding fabric panel for each of the pair of shoulder panels couples at its front end to a chest panel via a coupling means comprising a first quick-release cable.

11. The system of claim 10, wherein the corresponding fabric panel for the rigid back plate couples to a pair of waist panels via a second quick-release cable, and wherein the pair of waist panels couples at their front ends to the chest panel.

12. The system of claim 11, further comprising a quick-release mechanism coupled to said first and second quick-release cables, wherein engaging the quick-release mechanism results in decoupling the chest panel from the pair of curved shoulder panels and the back panel from the pair of waist panels.

13. The system of claim 1, wherein the rigid back plate is further adapted to receive one or more racks, each of the one or more racks including attachment points for additional equipment.

14. A tactical vest, comprising:

a back panel coupled to a pair of shoulder panels and removably coupled to a pair of waist panels; and a chest panel coupled to the pair of waist panels and removably coupled to the pair of shoulder panels;

wherein each removable coupling comprises one or more quick-release cables; and wherein a first quick-release cable is routed through a channel in a fabric strip fixedly coupled to each of the pair of waist panels, each fabric strip being inserted through a corresponding fabric loop fixedly coupled to the back panel.

15. The tactical vest of claim 14, wherein a second quick-release cable is routed through a channel in a fabric strip fixedly coupled to each upper corner of the chest panel, each fabric strip being inserted through a corresponding fabric loop fixedly coupled to each shoulder panel.

16. The tactical vest of claim 14, wherein removing the one or more quick-release cable from each removable coupling decouples the removably coupled panels.

17. The tactical vest of claim 16, further comprising a quick-release mechanism coupled to each of the quick-release cables, wherein engaging the quick-release mechanism removes each of the quick-release cables from their respective coupling.

18. A tactical vest, comprising:

a back panel coupled to a pair of shoulder panels and removably coupled to a pair of waist panels; and a chest panel coupled to the pair of waist panels and removably coupled to the pair of shoulder panels;

wherein each removable coupling comprises one or more quick-release cables; and wherein a quick-release cable is routed through a channel in a fabric strip fixedly coupled to each upper corner of the chest panel, each fabric strip being inserted through a corresponding fabric loop fixedly coupled to each shoulder panel.

* * * * *